US006855469B2

(12) United States Patent
Ikeda et al.

(10) Patent No.: US 6,855,469 B2
(45) Date of Patent: Feb. 15, 2005

(54) FULL-COLOR IMAGE-FORMING METHOD, AND TWO-COMPONENT DEVELOPER KIT FOR FORMING FULL-COLOR IMAGES

(75) Inventors: Naotaka Ikeda, Ibaraki (JP); Kenji Okado, Shizuoka (JP); Yushi Mikuriya, Shizuoka (JP); Shinya Yachi, Shizuoka (JP); Kazumi Yoshizaki, Ibaraki (JP); Katsuyuki Nonaka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 10/274,898

(22) Filed: Oct. 22, 2002

(65) Prior Publication Data

US 2003/0122918 A1 Jul. 3, 2003

(30) Foreign Application Priority Data

Oct. 22, 2001 (JP) ..... 2001-323114
Oct. 2, 2002 (JP) ..... 2002-290213

(51) Int. Cl.[7] ..... G03G 9/107

(52) U.S. Cl. ..... 430/45; 430/111.1; 430/111.4; 430/122; 399/262

(58) Field of Search ..... 430/45, 111.1, 430/111.4, 122; 399/262; 347/140

(56) References Cited

U.S. PATENT DOCUMENTS

| | | | | | |
|---|---|---|---|---|---|
| 4,430,402 | A | * | 2/1984 | Tsushima | 430/45 |
| 5,021,838 | A | * | 6/1991 | Parker et al. | 399/232 |
| 5,187,526 | A | | 2/1993 | Zaretsky | 355/273 |
| 5,281,502 | A | * | 1/1994 | Brewington et al. | 430/45 |
| 6,641,967 | B2 | * | 11/2003 | Takiguchi et al. | 430/120 |

FOREIGN PATENT DOCUMENTS

| | | |
|---|---|---|
| JP | 36-10231 | 7/1961 |
| JP | 56-13945 | 4/1981 |
| JP | 59-53856 | 3/1984 |
| JP | 59-61842 | 4/1984 |
| JP | 1-43301 | 9/1989 |
| JP | 2-21591 | 5/1990 |
| JP | 3-145678 | 6/1991 |
| JP | 6-11901 | 1/1994 |
| JP | 7-50358 | 5/1995 |

OTHER PUBLICATIONS

European Search Report dated May 19, 2003 (Ref. No. EP 36474).

* cited by examiner

*Primary Examiner*—John L Goodrow
(74) *Attorney, Agent, or Firm*—Fitzpatrick, Cella, Harper & Scinto

(57) ABSTRACT

In a full-color image-forming method having at least a charging step, a latent-image-forming step, a developing step of developing an electrostatic latent image by the use of a developer; a transfer step, and a fixing step, the developer comprises a plurality of color developers and a black developer. The color developers are each a two-component developer for full-color image formation which has i) a color toner having color toner particles containing at least a binder resin, a colorant and a wax and ii) a carrier for the color developer. The black developer is a two-component developer for full-color image formation which has i) a black toner having black toner particles containing at least a binder resin, carbon black and a wax and ii) a carrier for the black developer. The carrier for the black developer has a larger absolute value of charge quantity when the same toner is used, than the respective carriers for the color developers.

19 Claims, 6 Drawing Sheets

FULL-COLOR IMAGE-FORMING METHOD, AND TWO-COMPONENT DEVELOPER KIT FOR FORMING FULL-COLOR IMAGES

BACKGROUND OF THE INVENTION

1. Field of the Invention

This invention relates to an image-forming method making use of developers for full colors, used to carry out recording processes utilizing electrophotography or electrostatic recording. More particularly, it relates to a full-color image-forming method and a two-component developer kit which are used in image-forming apparatus usable in copying machines, printers, facsimile machines, plotters and so forth.

2. Related Background Art

A number of methods are conventionally known as methods for electrophotography. Copies or prints are commonly obtained by forming an electrostatic latent image on an electrostatic-image-bearing member by utilizing a photoconductive material and by various means, subsequently developing the electrostatic latent image by the use of a toner to form a toner image, transferring the toner image to a transfer medium such as paper as occasion calls, and thereafter fixing the toner image to the transfer medium by heat, pressure or heat-and-pressure.

In full-color copying machines, full-color printers and so forth, it has been common to use a method in which a transfer material is wound on the surface of a transfer member holding member (transfer drum) set opposingly to one photosensitive member, the transfer material being wound by an electrostatic force or a mechanical action of a gripper or the like, and the process from development to transfer is carried out four times to obtain a full-color image (a transfer drum system); or a method in which, using four electrostatic-image-bearing members, electrostatic latent images formed respectively on the electrostatic-image-bearing members are developed by the use of a yellow developer, a magenta developer, a cyan developer and a black developer, and, transporting a transfer material by means of a beltlike transfer member, the toner images of the respective colors are transferred to the transfer material, followed by fixing to form a full-color image (a tandem system).

In recent years, as to transfer materials for full-color image formation, it has become increasingly necessary to deal with not only sheets of paper usually used and films for overhead projectors (OHP), but also sheets of cardboard or small-sized sheets of paper such as cards and post cards. In the transfer drum system, since the transfer material is wound on the surface of the transfer drum, there is a disadvantage that cardboard such as post cards cannot be used. On the other hand, in the tandem system, since the transfer material is transported in the state of a flat sheet, this system is widely applicable to various types of transfer materials. However, a plurality of toner images must exactly be transferred without any color differences. Hence, this system tends to cause defective images due to faulty transfer of toner. In order to solve this problem, it has been attempted to add to toners various additives such as a fluidity improver in order to improve toner transfer performance without any color differences to make images high-quality.

However, it is difficult to remove a problem of toner scatter or to satisfy image characteristics such as image density, image quality and so forth of images to be obtained, if the transfer performance and chargeability of the respective color toners are balanced without taking account of the electrical resistance of colorants added internally to toner particles, i.e., the electrical resistance of high-resistance organic colorants and that of inorganic colorants including low-resistance carbon black. Also, if any differences in electrical resistance of colorants are taken into account, color differences may appear in glossiness, image density, coloring power and so forth of the respective color toners, and it is still difficult to satisfy the image characteristics in the case when, as far as color non-uniformity, color balance or the like is taken into account. In Japanese Patent Application Laid-open No. 6-11901, it is attempted to improve transfer performance by making a fluidity improver (titanium oxide) of a black toner have a higher volume resistivity than color toners, taking account of the differences in electrical resistance of colorants. This method certainly brings about an improvement in transfer performance, but may take the desired effect with difficulty when the titanium oxide is in a small quantity, or, when it is added in a large quantity, the black toner tends to have a low chargeability, and hence the fluidity improver cannot be used in the required quantity from the viewpoint of improvement in fluidity. Thus, it has been difficult to achieve both toner fluidity and transfer performance.

Meanwhile, image-forming methods making use of an intermediate transfer member (intermediate transfer system) are also proposed.

For example, a full-color image forming apparatus making use of a drum-shaped intermediate transfer member is disclosed in U.S. Pat. No. 5,187,526. Also, in Japanese Patent Publication No. 7-50358, a recording method is disclosed in which a plurality of color toner images are superimposingly transferred in sequence from a plurality of electrostatic-image-bearing members to an intermediate transfer member, and the toner images on the intermediate transfer member are further transferred to a transfer material. The intermediate transfer system has advantages in that it makes any complicated optical system unnecessary, it can also be used to form images on stiff paper such as postcards and cardboard, and still also it can make the apparatus itself compact when an intermediate transfer belt is used because the belt is flexible.

In the system making use of such an intermediate transfer member, the toner image is primarily transferred from the electrostatic-image-bearing member such as a photosensitive member to the intermediate transfer member and thereafter it must further be transferred from the intermediate transfer member to the transfer material. Accordingly, the toner transfer efficiency must be made higher than that in conventional cases. More specifically, in developing systems making use of the intermediate transfer member, the toner image is transferred twice so as to be formed on the transfer material, and hence any image defects concerning the transfer performance of toner tend to occur.

In a full-color intermediate transfer system making use of the intermediate transfer member, toners are present on the intermediate transfer member in a larger quantity than in the case of a monochromatic black toner used in black-and-white copying machines, and hence their transfer efficiency more tends to lower. More specifically, in the formation of a full-color image, toner images formed by superimposing two or more color toners may uniformly be transferred with difficulty, so that, when the intermediate transfer member is used, problems tend to occur in respect of color uniformity or color balance. Thus, it is not easy to stably reproduce full-color images having a high image quality.

In particular, with toner images formed by superimposing two or more color toners inclusive of a black toner, a poor transfer performance may cooperatively result because of a lower transfer performance of the black toner to tend to cause image defects. A black toner making use of an inorganic colorant including low-resistance carbon black as a colorant may have a lower charge quantity than a yellow toner, a magenta toner and a cyan toner (hereinafter often simply "color toners" distinguishing from the black toner) each making use of a high-resistance organic colorant, and also tends to cause a lowering of transfer efficiency with a decrease in charge quantity at the time of its transfer from the electrostatic-image-bearing member to the intermediate transfer member and a lowering of transfer efficiency with a decrease in charge quantity at the time of its transfer from the intermediate transfer member to the transfer material, as well as line-image blank areas caused by poor transfer, fog, and toner scatter (black spots around line images). Also, its transfer performance and chargeability may greatly be influenced depending on the state of dispersion of carbon black in toner particles. Hence, the above problems may become remarkable especially in the image-forming method making use of the intermediate transfer member, in which the toner image is transferred twice. Accordingly, it is difficult for the black toner to be improved in its balance with the color toners.

In order to remove the transfer residual toner coming at the time of transfer from the intermediate transfer member to the transfer material, the intermediate transfer member is also often provided with a cleaning member, which, however, is not preferable in view of the lifetime of the intermediate transfer member. Accordingly, it is sought to improve the transfer efficiency.

Moreover, black-and-white images are reproduced in an unexpectedly large proportion even in full-color printers. Hence, the black toner or developer may deteriorate earlier than the color toners, so that the difference in transfer performance may become more pronounced between the black toner and the color toners to cause image defects.

Meanwhile, in order to prevent developers from deterioration to achieve stable developing performance even in long-term use, a developing assembly of a system in which the carrier in a developer chamber is little by little supplied has been proposed. As a typical example of the developing assembly of such a system, as disclosed in, e.g., Japanese Patent Publications No. 2-21591 and No. 1-43301 and Japanese Patent Application Laid-open No. 3-145678, a developing assembly is known in which a virgin carrier is little by little supplied from a developer supply unit to the developing assembly, and on the other hand the old developer remaining in the developing assembly to become excess as a result of this supply is discharged by making it overflow from a developer-discarding opening to collect it in a developer collection container.

In such a developing assembly, the chargeability of the developer continues deteriorating until a certain service time has lapsed after the virgin carrier has been filled in the developing assembly, but thereafter becomes stable to become substantially constant as the virgin carrier is little by little supplied and the old developer is little by little discharged. Also, the developer collection container may be replaced after it has become full with the developer collected, and hence it is unnecessary to make any periodic replacement in accordance with the deterioration of the carrier. Also, such a developing system, though having a complicated main-body construction, can be a system having an advantage that any toner may fly up with difficulty when only the developer collection container is replaced. Moreover, any periodic replacement with fresh developers by a serviceman or someone else may be made less times, making it possible to reduce running cost.

However, in a developing system having a carrier supply unit in addition to a toner supply unit as disclosed in Japanese Patent Publication No. 2-21591, the carrier and the toner must be supplied in quantities controlled independently. This not only makes their control complicated, but also cannot make the apparatus compact. Also, as disclosed in the above Japanese Patent Publication No. 1-43301 and Japanese Patent Application Laid-open No. 3-145678, in a developing system in which the carrier is incorporated in a replenishing developer, a stable chargeability of the developer can certainly be maintained over a long period of time. However, the problems in transfer performance as discussed above must be eliminated before the demand in recent years for making image quality higher is satisfied.

SUMMARY OF THE INVENTION

An object of the present invention is to provide a full-color image-forming method and a two-component developer kit for full-color image formation which have solved the above problems the related background art has had.

Another object of the present invention is to provide a full-color image-forming method and a two-component developer kit for full-color image formation in which the transfer performance of the black toner is improved to make it free of the difference in transfer performance from color toners so that images can be obtained which are free of fog and toner scatter, free of color non-uniformity and excellent in color balance.

To achieve the above objects, the present invention provides a full-color image-forming method having at least a charging step of charging an electrostatic-image-bearing member electrostatically; a latent-image-forming step of forming an electrostatic latent image on the electrostatic-image-bearing member having been charged; a developing step of developing the electrostatic latent image by the use of a developer held in a developing assembly, to form a toner image; a transfer step of transferring to a transfer material the toner image having been formed; and a fixing step of fixing the toner image to the transfer material;

the developer used in the developing step comprising a plurality of color developers and a black developer;

the color developers being each a two-component developer for full-color image formation which has i) a color toner having color toner particles containing at least a binder resin, a colorant and a wax and ii) a carrier for the color developer; and the black developer being a two-component developer for full-color image formation which has i) a black toner having black toner particles containing at least a binder resin, carbon black and a wax and ii) a carrier for the black developer;

the carrier for the black developer having a larger absolute value of charge quantity when the same toner is used, than the respective carriers for the color developers.

The present invention also provides a two-component developer kit comprising a plurality of color developers and a black developer;

the color developers being each a two-component developer for full-color image formation which has i) a color toner having color toner particles containing at least a binder resin, a colorant and a wax and ii) a carrier for the color developer; and the black developer being a two-component developer for full-color image formation which has i) a black toner having black toner particles containing at least a binder resin, carbon black and a wax and ii) a carrier for the black developer;

the carrier for the black developer having a larger absolute value of charge quantity when the same toner is used, than the respective carriers for the color developers.

DETAILED DESCRIPTION OF THE PREFERRED EMBODIMENTS

Figure 1:
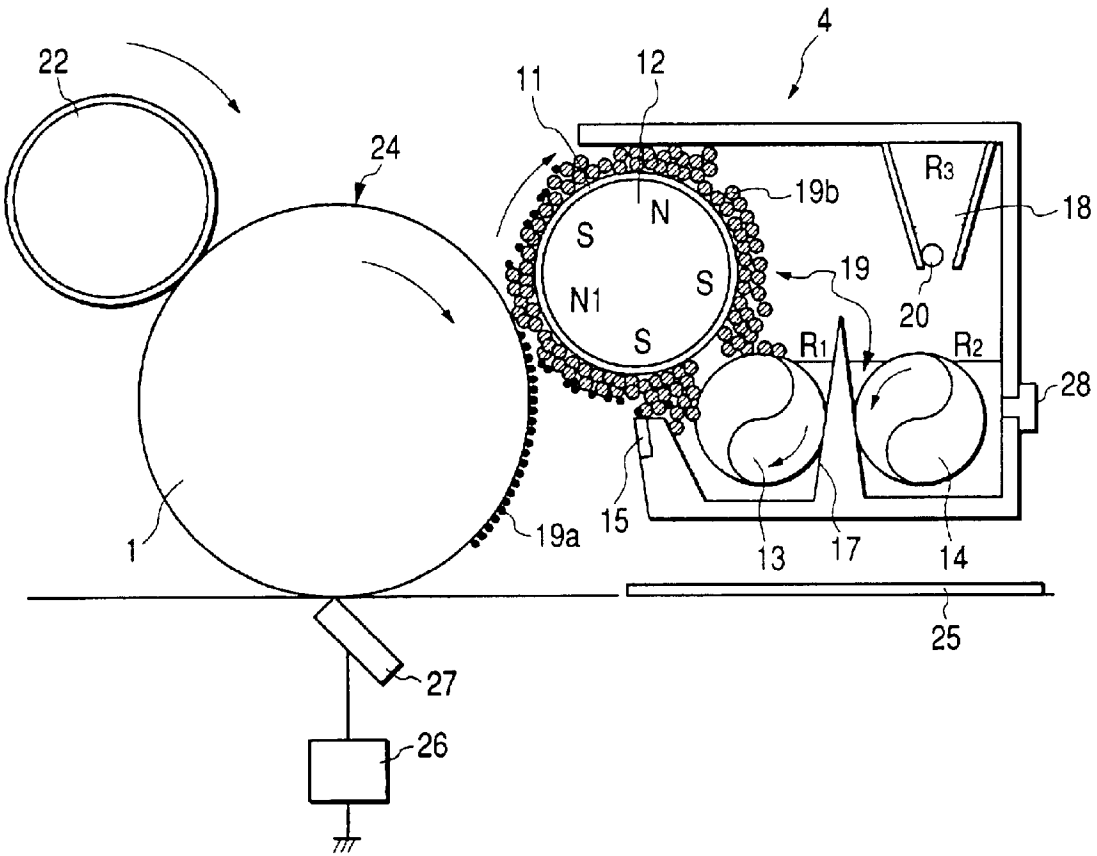
FIG. 1 is a diagrammatic view showing a preferred example of a developing system having a developing assembly usable in the present invention.

In the two-component developers for full-color image formation according to the present invention, which comprises a plurality of color developers and a black developer, the black developer has a carrier having a larger absolute value of charge quantity (a higher charge-providing ability) when the same toner is used, than carriers for the color developers. Hence, when used in full-color copying machines, full-color printers or the like, requirements for both black-image copying or printing and full-color image copying or printing can be satisfied and good images can be obtained.

More specifically, the full-color image-forming method of the present invention enables faithful transfer of toner images formed by development, from an electrostatic-image-bearing member to an intermediate transfer member and from the intermediate transfer member to a transfer material, so that stable transferred images can be obtained, including minute dot latent images such as halftone dots and digital latent images up to solid latent images.

The reason why the effect as stated above is obtainable in the full-color image-forming method of the present invention is presumed as follows: In general, black toners make use of a low-resistance inorganic colorant such as carbon black as a colorant, and hence tend to have a lower charge quantity after all, than other color toners making use of high-resistance organic colorants. They also have an inferior transfer performance because of a great lowering of transfer efficiency with a decrease in charge quantity at the time of transfer from the electrostatic-image-bearing member to the intermediate transfer member and from the intermediate transfer member to the transfer material. Moreover, since black toners make use of the inorganic colorant such as carbon black as a colorant, the toner is harder than the color toners making use of organic colorants, to tend to offset at the time of fixing. Hence, when a wax is incorporated in toner particles, the wax may have to be added in a larger quantity in the case of black toners than in the case of color toners. However, the chargeability may lower with an increase in the wax in toner particles, and the transfer performance also tends to become poor.

Accordingly, it is considered that the carrier in the black developer may be made to have a higher charge-providing ability so that the transfer efficiency can be kept from lowering with a decrease in charge quantity, and toner images formed of color toners and a black toner can uniformly be transferred without any color difference. Especially where an image-forming method is used in which toner images are transferred twice using an intermediate transfer member, which tends to be influenced by transfer performance, or where an image-forming method is used which has employed a developing system that a carrier is contained in a replenishing developer, the carrier having deteriorated is successively collected and a fresh carrier is supplied (hereinafter often simply "auto-refresh developing system"), the employment of the full-color image-forming method of the present invention can eliminate the problems in respect of color non-uniformity and color balance, and full-color images with high resolution and high quality image can stably be reproduced over a long-term use.

The present invention is described below in greater detail by giving embodiments of the present invention.

As the carriers (for the black developer and for the color developers) used in the present invention, it is preferable to use particles of, e.g., a metal such as surface-oxidized or unoxidized iron, nickel, copper, zinc, cobalt, manganese, chromium or a rare earth element, or an alloy or oxide thereof, and ferrite; or magnetic-fine-particle-dispersed resin carriers each constituted of a binder resin, a metal oxide, a magnetic metal oxide and so forth. There are no particular limitations on methods for their production.

As the carriers used in the present invention, the magnetic-fine-particle-dispersed resin carriers may preferably be used for the following reasons. Each magnetic-fine-particle-dispersed resin carrier has a smaller true specific gravity than ferrite carriers or the like, and hence may apply a small load on the developer when the developer is controlled on a developing sleeve to a stated thickness by means of a developer layer thickness control member or when the developer is agitated in a developer container. Hence, even where the developer is used over a long period of time, the carrier and the toner may deteriorate with difficulty, and hence good transfer performance can be maintained and any lowering of developing performance which may cause fog, toner scatter and so forth may occur with difficulty. In particular, in full-color copying machines and full-color printers, black-and-white images are reproduced in a large proportion, and the black developer may deteriorate earlier than the color developers. Hence, the magnetic-fine-particle-dispersed resin carrier is preferable as a carrier which can maintain good transfer performance and developing performance over a long period of time. Also, a polymerization magnetic-fine-particle-dispersed resin carrier containing a non-magnetic metal oxide and magnetite enables any desired control of magnetic properties and electrical resistance, has less strain due to shape in its particles, enables achievement of sharp particle size distribution, can be made relatively with ease to have spherical shape promising a high particle strength, and has a superior fluidity. Hence, the polymerization magnetic-fine-particle-dispersed resin carrier, having a small true specific gravity and a superior fluidity, is preferable as the replenishing developer for the image-forming method employing an auto-refresh developing system in which the carrier is contained in the replenishing developer, in order to improve charge stability of the developer in the developer container, because the carrier can be prevented from gathering on one side in a container for holding the replenishing developer and has a good dispersibility. Its particle size and electrical resistance can also be controlled over a wide range, and hence it is suited for, and particularly preferred in, high-speed copying machines and high-speed laser beam printers whose developing sleeve or magnet in the sleeve is rotated in a large number of revolutions.

In the present invention, as methods by which the carrier for the black developer is made to have a larger absolute value of charge quantity when the same toner is used, than the respective carriers for the color developers, known methods of controlling the charge-providing ability of carriers may be used. For example, a method by which the carrier for the black developer used in the present invention is made to have a larger absolute value of charge quantity when the same toner is used, than the respective carriers for the color developers may include a method in which an iron powder is subjected to oxidation; a method in which the physical properties of the carriers are controlled by changing constituent materials such as ferrite and magnetite and also changing the surface shape and particle diameter of these constituent materials, the type and quantity of surface coating materials therefor, manner of treatment therefor and so forth; and a method in which the carrier for the black developer and the carriers for the color developers are made different in kind (e.g., combination of a ferrite carrier with magnetic-fine-particle-dispersed resin carriers). In the present invention, any method may be used as long as the carrier for the black developer has a larger absolute value of charge quantity when the same toner is used, than the respective carriers for the color developers. There are no particular limitations thereon.

In Examples given later, the charge quantity of each carrier is measured on the basis of that of a cyan toner. Thus, for example, the cyan toner may be used as a toner for measuring the charge quantity of the carrier for the black developer and that of the carriers for the color developers.

The absolute value of charge quantity of the carrier for the black developer and that of the carriers for the color developers when the same toner(s) is/are used may preferably differ in an extent of from 1 to 20 mC/kg, and more preferably from 2 to 15 mC/kg. If it is smaller than 1 mC/kg, any desired transfer performance may not be achievable in respect of the black developer. If it is larger than 20 mC/kg, the black developer tends to cause charge-up and so forth, and it may be difficult to achieve developing performance which is stable over a long period of time.

How to measure the charge quantity is described later.

In particular, in the present invention, from the viewpoint of readiness in controlling the charge-providing ability to the toner while maintaining carrier's properties other than the charge-providing ability without color difference, a carrier is preferred which has been obtained by treating the surface of carrier core particles with a coating agent, and the charging performance (in other words, charge-providing performance to toner) of the carrier may preferably be controlled by changing the type and quantity of the coating agent with which the carrier core particles are coated, and the manner of treatment therefor (in particular, sintering temperature). In particular, it is preferable to use a resin having an amino group, a coupling agent having an amino group, or a resin containing a coupling agent having an amino group. Details for the manner of treatment are described later.

There are no particular limitations on the coating agent resin with which the carrier core particles are coated. Stated specifically, it may include, e.g., polystyrene; acrylic resins such as a styrene-acrylate copolymer; and vinyl chloride, vinyl acetate, polyvinylidene fluoride resins, fluorocarbon resins, perfluorocarbon resins, solvent-soluble perfluorocarbon resins, polyvinyl alcohol, polyvinyl acetal, polyvinyl pyrrolidone, petroleum resins, cellulose, cellulose derivatives, novolak resins, low-molecular-weight polyethylene, saturated alkyl polyester resins, aromatic polyester resins, polyamide resins, polyacetal resins, polycarbonate resins, polyether sulfone resins, polysulfone resins, polyphenylene sulfide resins, polyether ketone resins, phenolic resins, modified phenolic resins, maleic resins, alkyd resins, epoxy resins, acrylic resins, unsaturated polyesters obtained by polycondensation of maleic anhydride and terephthalic acid with a polyhydric alcohol, urea resins, melamine resins, urea-melamine resins, xylene resins, toluene resins, guanamine resins, melamine-guanamine resins, acetoguanamine resins, Glyptal resin, furan resins, silicone resins, polyimide resins, polyamide-imide resins, polyetherimide resins and polyurethane resins. Any of these resins may be used alone or in combination of two or more.

In particular, silicone resins may preferably be used from the viewpoint of adherence to cores and prevention of carrier-spent. Any silicone resin may be used alone, but may preferably be used in combination with a coupling agent in order to improve the strength of coat layers to control the carrier to have preferable charging performance. Also, as to the coupling agent, at least part thereof may preferably be used as what is called a primer with which carrier core surfaces are treated before they are coated with the resin. In such a case, layers formed by treatment with the primer and resin coat layers can be formed in the state of higher close adhesion involving covalent bonding.

As the coupling agent, an aminosilane may preferably be used. As a result, amino groups having positive chargeability can be introduced to carrier particle surfaces, and the toner can well be provided with negative charges. Also, the presence of amino groups activates a lipophilic treating agent and the silicone resin, the former being preferably used for treating the metallic compound used as carrier cores. Hence, it further improves the adherence of the silicone resin to the carrier cores, and at the same time accelerates the curing of the resin so that stronger coat layers can be formed.

In the present invention, as described above, the carrier core surfaces may preferably be treated with the resin having an amino group, the coupling agent having an amino group or the resin containing a coupling agent having an amino group. More preferably, the carrier core surfaces may be treated with the silane coupling agent having an amino group or the resin containing a coupling agent having an amino group. Still more preferably, in the carriers for the black developer and color developers, the charging performance of each carrier may preferably be controlled by using the same silane coupling agent having an amino group and/or resin containing a silane coupling agent having an amino group, and by controlling the quantity thereof (the quantity of the silane coupling agent having an amino group and/or resin containing a silane coupling agent having an amino group, of the carrier for the black developer is made larger than that of the carriers for the color developers). Otherwise, with regard to the silane coupling agent having an amino group and/or resin containing a silane coupling agent having an amino group, those in which the amine equivalent weight in the carrier for the black developer is larger than the amine equivalent weight in the carriers for the color developers may be used to control the charging performance of the carrier. This is preferable in view of an advantage that the charge-providing ability can stably be controlled with ease.

The amine equivalent weight is the equivalent weight (g/eqiv) per one amine, and is the value found by dividing molecular weight by the number of amines per one molecule.

The carriers according to the present invention may each preferably have a volume-based 50% particle diameter (D50) of from 15 μm to 45 μm, and more preferably from 20 μm to 40 μm.

If the volume-based 50% particle diameter of the carriers is less than 15 μm, the carriers may have a low fluidity and may have low blendability with toners to tend to cause fog. If it is more than 45 μm, the carriers may have a low toner-holding performance to tend to cause toner scatter.

The volume-based 50% particle diameter is measured with a laser diffraction particle size distribution meter (manufactured by Horiba Seisakusho K.K.).

In the present invention, with regard to the absolute value of charge quantity when the same toner is used, in order to make that of the carrier for the black developer larger than that of the carriers for the color developers, the charge-providing ability of the carrier for the black developer and that of the carriers for the color developers may be controlled by adjusting carrier particle diameters.

In the present invention, the carriers may each preferably have a resistivity of from $1\times10^{8}$ Ω·cm to $1\times10^{16}$ Ω·cm, and more preferably from $1\times10^{9}$ Ω·cm to $1\times10^{15}$ Ω·cm.

If the carrier has a resistivity of less than $1\times10^{8}$ Ω·cm, the carrier tends to adhere to the electrostatic-image-bearing member surface, or may scratch the electrostatic-image-bearing member or be directly transferred onto paper, to tend to cause image defects. Also, the development bias may leak through the carrier to disorder the electrostatic latent images formed on the electrostatic-image-bearing member.

If the carrier has a resistivity of more than $1\times10^{16}$ Ω·cm, strongly edge-emphasized images tend to be formed. Also, the electric charges on the carrier particle surfaces may leak with difficulty, and hence such a carrier may cause a lowering of image density due to a phenomenon of charge-up, or may become unable to provide charge to toners supplied anew, to cause fog and toner scatter (spots around line images). Still also, such a carrier may charge substances such as inner walls of the developing assembly, so that the charge quantity of toners that is to be originally given may become non-uniform. Besides, any external additives may electrostatically adhere to the carrier to tend to cause image defects.

In the present invention, as a method by which the carrier for the black developer is made to have a larger absolute value of charge quantity when the same toner is used, than the carriers for the color developers, the charge-providing ability of the carrier for the black developer and that of the carriers for the color developers may be controlled by adjusting the resistivity of each carrier.

The resistivity of the carriers is measured with a powder insulation resistance measuring instrument manufactured by Shinku-Riko Inc. As measuring conditions, a carrier left for 24 hours or more under conditions of 23° C. and 60% RH is put in a measuring cell of 20 mm in diameter (0.283 $cm^2$), which is then sandwiched between 11.76 kPa (120 $g/cm^2$) loading electrodes, setting the thickness to 2 mm, to make measurement at an applied voltage of 500 V.

As magnetic properties, the carriers may each have a low magnetic force such that the intensity of magnetization at 1,000/4π kA/m is preferably from 20 to 100 $Am^2/kg$, and more preferably from 30 to 65 $Am^2/kg$.

If the carrier's intensity of magnetization is more than 100 $Am^2/kg$, which is also concerned in the carrier particle diameter, the magnetic brush formed on the developing sleeve at the development pole may decrease in density to come to have a large ear length and become rigid, tending to cause uneven sweep marks on copied or printed images and tending to cause running deterioration of developers especially as a result of copying or printing on many sheets.

If the carrier's intensity of magnetization is less than 20 $Am^2/kg$, the carrier may have a low magnetic force even if carrier fine powder is removed, to tend to cause the adhesion of the magnetic-fine-particle-dispersed resin carrier, tending to cause a lowering of toner transport performance.

The magnetic properties of the carriers is measured with a vibration magnetic-field type magnetic-characteristics autographic recorder BHV-35, manufactured by Riken Denshi K.K. As conditions for measurement, an external magnetic field of 1,000/4π kA/m is formed, and the intensity of magnetization when it is formed is determined in the following way: A cylindrical plastic container is filled with the carrier in the state it has well densely been packed so that carrier particles do not move. In this state, the magnetic moment is measured, and the actual weight when the sample is put in is measured to determine the intensity of magnetization ($Am^2/kg$).

In the present invention, with regard to the absolute value of charge quantity when the same toner is used, in order to make that of the carrier for the black developer larger than that of the carriers for the color developers, the charge-providing ability of the carrier for the black developer and that of the carriers for the color developers may be controlled by adjusting the magnetization of the carriers.

In the present invention, metallic-compound particles may preferably be used as the carrier cores. Stated specifically, they may include particles of a magnetite or ferrite having composition represented by the following formula (1) or (2).

$$MO.Fe_2O_3 \quad (1)$$

$$M.Fe_2O_4 \quad (2)$$

wherein M represents a trivalent, divalent or monovalent metallic ion.

The M may include Mg, Al, Si, Ca, Sc, Ti, V, Cr, Mn, Fe, Co, Ni, Cu, Zn, Sr, Y, Zr, Nb, Mo, Cd, Sn, Ba, Pb and Li. Any of these may be used alone or in plurality.

Specific compounds of such metallic-compound particles having magnetic properties may include, e.g., iron oxides such as magnetite, Zn—Fe ferrite, Mn—Zn—Fe ferrite, Ni—Zn—Fe ferrite, Mn—Mg—Fe ferrite, Ca—Mn—Fe ferrite, Ca—Mg—Fe ferrite, Li—Fe ferrite and Cu—Zn—Fe ferrite.

The magnetic-fine-particle-dispersed resin carrier preferably used in the present invention is described below.

In the present invention, as metallic-compound particles used in carrier cores in the magnetic-fine-particle-dispersed resin carrier, the above metallic compound having magnetic properties and the following non-magnetic metallic compound may be used in the form of a mixture.

The non-magnetic metallic compound may include, e.g., $Al_2O_3$, $SiO_2$, CaO, $TiO_2$, $V_2O_5$, CrO, $M_nO_2$, α-$Fe_2O_3$, γ-$Fe_2O_3$, CoO, NiO, CuO, ZnO, SrO, $Y_2O_3$ and $ZrO_2$. In this case, one kind of metallic compound may be used. Particularly preferably, at least two or more kinds of metallic compounds may be used in the form of a mixture. In such a case, particles having similar specific gravity and shape may be used. This is more preferable in order to enhance the adherence to the binder resin and the strength of carrier core particles.

As specific examples of combination of the above compound having magnetic properties with the non-magnetic metallic compound, preferably usable are magnetite/hematite, magnetite/$\gamma$-$Fe_2O_3$, magnetite/$SiO_2$, magnetite/$Al_2O_3$, magnetite/$TiO_2$, magnetite/Ca—Mn—Fe ferrite and magnetite/Ca—Mg—Fe ferrite. Of these, the combination of magnetite/hematite may particularly preferably be used.

Where the metallic compound showing magnetic properties is used alone or where it is used in combination with the non-magnetic metallic compound, the metallic compound showing magnetic properties may preferably have a number-average particle diameter of from 0.02 $\mu$m to 2 $\mu$m, and more preferably from 0.05 to 1 $\mu$m, which may vary depending on the number-average particle diameter of the carrier cores.

If the metallic compound showing magnetic properties has a number-average particle diameter of less than 0.02 $\mu$m, any preferable magnetic properties may be attained with difficulty. If the metallic compound showing magnetic properties has a number-average particle diameter of more than 2 $\mu$m, granulation tends to be non-uniform when the carriers are produced, to make it difficult to obtain carriers having high strength and preferable particle diameters.

Where the metallic compound showing magnetic properties is used in combination with the non-magnetic metallic compound, the non-magnetic metallic compound may preferably have a number-average particle diameter of from 0.05 $\mu$m to 5 $\mu$m, and more preferably from 0.1 to 3 $\mu$m.

To measure the number-average particle diameter, using a photographic image magnified to 5,000 to 20,000 times on a transmission electron microscope H-800, manufactured by Hitachi Ltd., trade name: FE-SEM, S-800, at least 300 particles of 0.01 $\mu$m or more in particle diameter are picked up at random to measure their horizontal-direction Feret's diameter as metallic-compound particle diameter using an image processing analyzer LUZEX-3, manufactured by Nireko Co., followed by averaging processing to calculate the number-average particle diameter.

With regard to the resistivity (specific resistance) of the metallic compound(s) dispersed in the binder resin, the metallic compound particles having magnetic properties may preferably be those having a resistivity within a range of $1\times10^3$ $\Omega$·cm or more. Especially when the metallic compound having magnetic properties is used in combination with the non-magnetic metallic compound, the metallic compound particles having magnetic properties may preferably be those having a resistivity within a range of $1\times10^3$ $\Omega$·cm or more, and as the other non-magnetic metallic compound particles it is preferable to use those having a resistivity higher than that of the metallic compound particles having magnetic properties, and the non-magnetic metallic compound particles may preferably be those having a resistivity of $1\times10^8$ $\Omega$·cm or more, $1\times10^{10}$ $\Omega$·cm or more.

If the metallic compound particles having magnetic properties have a resistivity of less than $1\times10^3$ $\Omega$·cm, the desired high resistivity may be achieved with difficulty even if their content is made smaller, to cause the injection of electric charges to tend to cause deterioration of image quality or carrier adhesion. Also, in the case when the metallic compound having magnetic properties is used in combination with the non-magnetic metallic compound, if the non-magnetic metallic compound particles have a resistivity of less than $1\times10^8$ $\Omega$·cm, the magnetic carrier cores may have a low resistivity to make it difficult to obtain the effect of the present invention.

In the present invention, the resistivity of the metallic compound particles having magnetic properties and that of the non-magnetic metallic compound particles may be measured according to the measurement of the resistivity of the carriers.

In the magnetic-fine-particle-dispersed resin carrier according to the present invention, the metallic compound may preferably be in a content of from 80 to 99% by weight based on the weight of the carrier cores.

If the metallic compound is in a content of less than 80% by weight, the carrier may have an unstable charging performance. Especially in a low-temperature and low-humidity environment, the carrier may become charged and any residual electric charges of such a carrier tend to remain. Hence, fine toners and external additives tend to adhere to the particle surfaces of the magnetic-fine-particle-dispersed resin carrier, and also any suitable specific gravity may be achieved with difficulty. If the metallic compound is in a content of more than 99% by weight, the magnetic-fine-particle-dispersed resin carrier may have a low strength to tend to cause problems such that the magnetic-fine-particle-dispersed resin carrier may break as a result of running.

As a preferred embodiment of the present invention, in magnetic-fine-particle-dispersed resin carrier cores containing the metallic compound having magnetic properties and the non-magnetic metallic compound, the metallic compound having magnetic properties may also preferably be in a content of from 50 to 95% by weight, and more preferably from 55 to 95% by weight, based on the total weight of the metallic compounds contained.

If the metallic compound having magnetic properties is in a content of less than 50% by weight based on the total weight of the metallic compounds contained, the carrier cores may be made well high-resistance, but on the other hand may have a small magnetic force required as the magnetic-fine-particle-dispersed resin carrier to cause carrier adhesion. If the metallic compound having magnetic properties is in a content of more than 95% by weight based on the total weight of the metallic compounds contained, the carrier cores may not be made more preferably high-resistance although it depends on the resistivity of the metallic compound having magnetic properties.

In the present invention, where the magnetic-fine-particle-dispersed resin carriers are used, with regard to the absolute value of charge quantity when the same toner is used, in order to make that of the carrier for the black developer larger than that of the carriers for the color developers, the charge-providing ability of the carrier for the black developer and that of the carriers for the color developers may be controlled by adjusting the quantities and types of the magnetic and non-magnetic metallic compounds to change physical properties.

As the binder resin in the cores of the magnetic-fine-particle-dispersed resin carrier, a thermosetting resin may preferably be used, and it may preferably be a resin part or the whole of which has three-dimensionally been cross-linked. This enables the dispersed metallic-compound particles to bind firmly, and hence enables the magnetic-fine-particle-dispersed resin carrier cores to have a high strength, so that the metallic compound(s) may come off with difficulty even in copying or printing on many sheets and further the cores can better be coated with the coat layers. As the result, any adsorbed water content of carrier cores can be controlled with ease.

As a method of obtaining the carrier cores, though not limited to the method described below, what is preferable in the present invention is a method of producing them by a polymerization process in which in a solution prepared by dispersing or dissolving a monomer and a solvent uniformly the monomer is polymerized to form particles. In particular, a method is preferable in which a metallic compound having been subjected to lipophilic treatment is used to obtain magnetic-fine-particle-dispersed resin carrier cores having a sharp particle size distribution and containing less fine powder.

In the present invention, where the carriers are each used in combination with a toner with a small particle diameter, having a weight-average particle diameter of from 3.0 μm to 10 μm, the carriers may also preferably be made to have a small particle diameter in accordance with the particle diameter of the toner. This is particularly preferable because, in the production method described above, the carrier cores containing less fine powder can be produced without regard to their average particle diameter even when the carriers are made to have a small particle diameter.

As monomers used to obtain the binder resin of the magnetic-fine-particle-dispersed resin carrier core particles, radical polymerizable monomers may be used. Such monomers may include, e.g., styrene; styrene derivatives such as o-methylstyrene, m-methylstyrene, p-methoxylstyrene, p-ethylstyrene and p-tert-butylstyrene; acrylic acid, and acrylates such as methyl acrylate, ethyl acrylate, n-butyl acrylate, n-propyl acrylate, isobutyl acrylate, octyl acrylate, dodecyl acrylate, 2-ethylhexyl acrylate, stearyl acrylate, 2-chloroethyl acrylate and phenyl acrylate; methacrylic acid, and methacrylates such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminomethyl methacrylate, diethylaminomethyl methacrylate and benzyl methacrylate; 2-hydroxyethyl acrylate and 2-hydroxyethyl methacrylate; acrylonitrile, methacrylonitrile and acrylamide; vinyl ethers such as methyl vinyl ether, ethyl vinyl ether, propyl vinyl ether, n-butyl vinyl ether, isobutyl vinyl ether, β-chloroethyl vinyl ether, phenyl vinyl ether, p-methylphenyl vinyl ether, p-chlorophenyl vinyl ether, p-bromophenyl vinyl ether, p-nitrophenyl vinyl ether, and p-methoxyphenyl vinyl ether; and diene compounds such as butadiene.

Any of these monomers may be used alone or in the form of a mixture, and polymerization composition suitable for achieving preferable properties may be selected.

As described previously, the binder resin of the magnetic-fine-particle-dispersed resin carrier core particles may preferably be one having three-dimensionally been cross-linked. As a cross-linking agent used to cross-link the binder resin three-dimensionally, a cross-linking agent may preferably be used which has at last two polymerizable double bonds per one molecule. Such a cross-linking agent may include, e.g., aromatic divinyl compounds such as divinylbenzene and divinylnaphthalene; and ethylene glycol diacrylate, ethylene glycol dimethacrylate, triethylene glycol dimethacrylate, tetraethylene glycol dimethacrylate, 1,3-butylene glycol diacrylate, trimethylolpropane triacrylate, trimethylolpropane trimethacrylate, 1,4-butanediol diacrylate, neopentyl glycol diacrylate, 1,6-hexanediol diacrylate, pentaerythritol triacrylate, pentaerythritol tetraacrylate, pentaerythritol dimethacrylate, pentaerythritol tetramethacrylate, glycerol acryloxydimethacrylate, N,N-divinylaniline, divinyl ether, divinyl sulfide and divinyl sulfone. Any of these may be used in the form of an appropriate mixture of two or more types. The cross-linking agent may previously be kept added to a polymerizable mixture, or may appropriately be added in the course of polymerization as occasion calls.

Other monomers for the binder resin of the carrier core particles may include bisphenols and epichlorohydrin, serving as starting materials of epoxy resins; phenols and aldehydes for phenolic resins; urea and aldehydes for urea resins; and melamine and aldehydes.

The most preferable binder resin is a phenolic resin. Its starting materials may include phenolic compounds such as phenol, m-cresol, 3,5-xylenol, p-alkylphenols, resorcin and p-tert-butyl phenol; and aldehydes such as formalin, paraformaldehyde and furfural. In particular, the combination of phenol with formalin is preferred.

Where these phenolic resins or melamine resins are used, a basic catalyst may be used as a curing catalyst. As the basic catalyst, various ones used in producing usual resol resins may be used. Stated specifically, it may include amines such as ammonia water, hexamethylenetetramine, diethyltriamine and polyethyleneimine.

In the present invention, where the magnetic-fine-particle-dispersed resin carriers are used, with regard to the absolute value of charge quantity when the same toner is used, in order to make that of the carrier for the black developer larger than that of the carriers for the color developers, the charge-providing ability of the carrier for the black developer and that of the carriers for the color developers may be controlled by adjusting the quantities and types of the binder resin, cross-linking agent and metallic compound or by adjusting the production method to change physical properties.

In the present invention, where the magnetic-fine-particle-dispersed resin carriers are used, the metallic compound incorporated in the carrier cores may be one having been subjected to lipophilic treatment. This is preferable in order to make the magnetic carrier particles have a sharp particle size distribution and to prevent the metallic compound particles from coming off from carrier particles. Where carrier core particles in which such a lipophilic-treated metallic compound has been dispersed are formed, particles having turned insoluble in the solution come formed simultaneously with progress of polymerization reaction, from a liquid medium in which a monomer and a solvent stand dispersed or dissolved uniformly. In that course, the metallic compound acts to be incorporated in the interiors of particles uniformly and in a high density and also acts to prevent the particles themselves from agglomerating one another to sharpen their particle size distribution, as so considered. Moreover, where the lipophilic-treated metallic compound is used, it is unnecessary to use any suspension stabilizer such as calcium fluoride. This can prevent the charging performance from being inhibited by any suspension stabilizer which may otherwise remain on the carrier particle surfaces, prevent the coating resin from being non-uniform when coated, and prevent the reaction from being inhibited when the carrier cores are coated with a reactive resin such as silicone resin. Also, the absence of such a suspension stabilizer on the particle surfaces and the elimination of any difficulties incidental thereto makes it easy to control the adsorbed water content of the carrier cores.

The lipophilic treatment may preferably be carried out using a lipophilic-treating agent which is an organic compound having at least one functional group selected from an epoxy group, an amino group and a mercapto group, or a mixture thereof. In particular, the one having an epoxy group is preferred in order to achieve the adsorbed water content within a preferable range and obtain the carriers having a stable charge-providing ability.

The magnetic metallic compound particles may preferably be treated with the lipophilic-treating agent in an amount of from 0.1 to 10 parts by weight, and more preferably from 0.2 to 6 parts by weight, based on 100 parts by weight of the magnetic metallic compound particles, in order to improve the lipophilicity and hydrophobicity of the magnetic metallic compound particles.

The lipophilic-treating agent having an epoxy group may preferably include γ-glycidoxypropylmethyldiethoxysilane, γ-glycidoxypropyltrimethoxysilane, β-(3,4-epoxycyclohexyl)trimethoxysilane, epichlorohydrin, glycidol and a styrene-glycidyl acrylic or methacrylic copolymer.

The lipophilic-treating agent having an amino group may include, e.g., γ-aminopropyltrimethoxysilane, γ-aminopropylmethoxydiethoxysilane, γ-aminopropyltriethoxysilane, N-β-(aminoethyl)-γ-aminopropyltrimethoxysilane, N-β-(aminoethyl)-γ-aminopropylmethyldimethoxysilane, N-phenyl-γ-aminopropyltrimethoxysilane, ethylenediamine, ethylenetriamine, styrene-dimethylaminoethylacrylate or methacrylate copolymer and isoporpyl tri(N-aminoethyl)titanate.

The lipophilic-treating agent having a mercapto group may include, e.g., mercaptoethyl alcohol, mercaptopropionic acid and γ-mercaptopropyltrimethoxysilane.

In the present invention, where the magnetic-fine-particle-dispersed resin carriers are used, with regard to the absolute value of charge quantity when the same toner is used, in order to make that of the carrier for the black developer larger than that of the carriers for the color developers, the charge-providing ability of the carrier for the black developer and that of the carriers for the color developers may also be controlled by adjusting the quantity and type of the lipophilic-treating agent and the production method to change physical properties.

In the present invention, the magnetic-fine-particle-dispersed resin carrier particles may preferably be coated with the resin having an amino group, coupling agent having an amino group, or resin containing a coupling agent having an amino group described previously, in order to make them have charge stability and environmental stability.

In the present invention, the carrier core particles may be produced by controlling the charge-providing ability of the carrier for the black developer and that of the carriers for the color developers by optionally carrying out granulation to provide a sharp particle size distribution or changing the sintering temperature, heating rate, heating retention time and so forth.

The carrier core particles used in the present invention may be produced by either of a continuous process and a batch process. Usually, the batch process is employed.

The toner contained in each of the black developer and color developers used in the present invention is described below.

The toner used in the present invention contains a wax. The wax may preferably be added in an amount of from 2 to 30 parts by weight, more preferably from 5 to 20 parts by weight, still more preferably from 8 to 20 parts by weight, and particularly preferably from 13 to 20 parts by weight based on 100 parts by weight of the binder resin.

In the polymerization toner production process, compared with the pulverization toner production process, the wax used has a lower polarity than the binder resin. Hence, the polymerization carried out in an aqueous medium makes it possible to use the wax in a larger quantity than in the pulverization toner production process because the wax can be incorporated in the interiors of toner particles in a large quantity with ease. This is especially effective for the effect of preventing offset at the time of fixing.

If the wax is mixed in a quantity smaller than the above lower limit, the effect of preventing offset at the time of fixing tends to lower. If it is in a quantity larger than the above upper limit, anti-blocking effect may lower to adversely affect the anti-offset effect to tend to cause melt adhesion of toner to photosensitive drum or melt adhesion of toner to developing sleeve. Especially in the case of the polymerization toner production process, a toner having a broad particle size distribution tends to be formed.

The black toner uses carbon black as the colorant, and hence, the toner is harder than the color toners making use of organic colorants, and tends to offset at the time of fixing. Accordingly, where the wax is incorporated in the toner particles, the black toner may have to contain the wax added in a larger quantity than the color toners. However, with an increase in quantity of the wax in the toner particles, the chargeability of the toner lowers and its transfer performance also tends to lower. In the present invention, the carrier for the black developer has a higher charge-providing ability than the carriers for the color developers, and hence, in the full-color developers making use of the black toner to which the wax is added in a larger quantity than in the color toners, the chargeability and transfer performance of the black toner can be kept from lowering, and well-balanced developing performance free of any color difference can be maintained.

The wax usable in the present invention may include, e.g., paraffin waxes, polyolefin waxes, modified products of these (e.g., oxides or grafted products), higher fatty acids and metal salts thereof, amide waxes, and ester waxes.

The colorant of the black toner used in the present invention may be exemplified by the following.

As a black colorant, carbon black is used.

The carbon black usable in the present invention may preferably be one having an average primary particle diameter of from 10 nm to 60 nm, and more preferably from 25 nm to 50 nm, and having a pH of from 6.0 to 11.0, and more preferably from 7.0 to 10.0, having a specific surface area of from 45 to 300 $m^2/g$, and more preferably from 50 to 100 $m^2/g$, and having a DBP oil absorption of from 10 to 100 ml/100 g, and more preferably from 25 to 60 ml/100 g.

The reasons for limitation to the above ranges are as follows: If the carbon black has an average primary particle diameter of less than 10 nm, the carbon black may agglomerate in the toner particles to tend to cause a lowering of the charge retention ability of the toner, a lowering of the charge quantity at the time of transfer from the electrostatic-image-bearing member to the intermediate transfer member and a lowering of the charge quantity at the time of transfer from the intermediate transfer member to the transfer material, tending to cause toner scatter and fog. If it has an average primary particle diameter of more than 60 nm, it may have a low coloring power. When the toner is obtained by polymerization, any carbon black having a pH of less than 6.0 or more than 11.0 may have so high an affinity for water that the carbon black may come to localize in the vicinity of toner particle surfaces to tend to cause a lowering of the charge retention ability of the toner, a lowering of the charge quantity at the time of transfer from the electrostatic-image-bearing member to the intermediate transfer member and a lowering of the charge quantity at the time of transfer from the intermediate transfer member to the transfer material, tending to cause toner scatter and fog. Also, if the carbon black has a specific surface area of more than 300 $m^2/g$, the phenomenon of toner scatter tends to occur at edge areas of visible images (toner images) formed (on the electrostatic-image-bearing member).

As to the DBP oil absorption, if it is less than 10 ml/100 g, the toner may provide a sufficient image density with difficulty. If on the other hand it is more than 100 ml/100 g, carbon black particles tend to agglomerate during the fixing of toner images.

In measuring the above physical properties of the carbon black, the particle diameter is measured by directly selectively examining the diameter of particles photographed on a scanning electron microscope. Methods of measuring the specific surface area, DBP oil absorption and pH value are described below.

Specific surface area:

The specific surface area is measured according to the BET method prescribed in ASTM Method D3037-78. Following the flow shown in FIG. 4, a mixed gas of $N_2$ and He is blown to carbon black (sample) to allow it to adsorb $N_2$, and its quantity is detected with a thermal conductivity cell. The specific surface area of the sample is found by calculation from the $N_2$ adsorption.

1) A sample is dried at 105° C. for 1 hour, and thereafter precisely weighed in an amount of from 0.1 to 1 g, which is then put in a U-shaped pipe 514, and this is attached to the flow path.

2) Flow control devices (capillary tubes) 510 and 511 are operated to change the $N_2$/He mixing ratio to set it to a prescribed $P/P_0$.

3) A cock is opened to introduce the adsorbing gas into the sample layer, and thereafter the U-shaped pipe 514 is immersed in liquid $N_2$ 513 to allow the sample to adsorb the $N_2$.

4) After the sample has reached adsorption equilibrium, the liquid $N_2$ 513 is removed, and the sample is exposed to air for about 30 seconds. Thereafter, the U-shaped pipe 514 is immersed in water kept at room temperature, to allow the sample to desorb the $N_2$.

Figure 4:
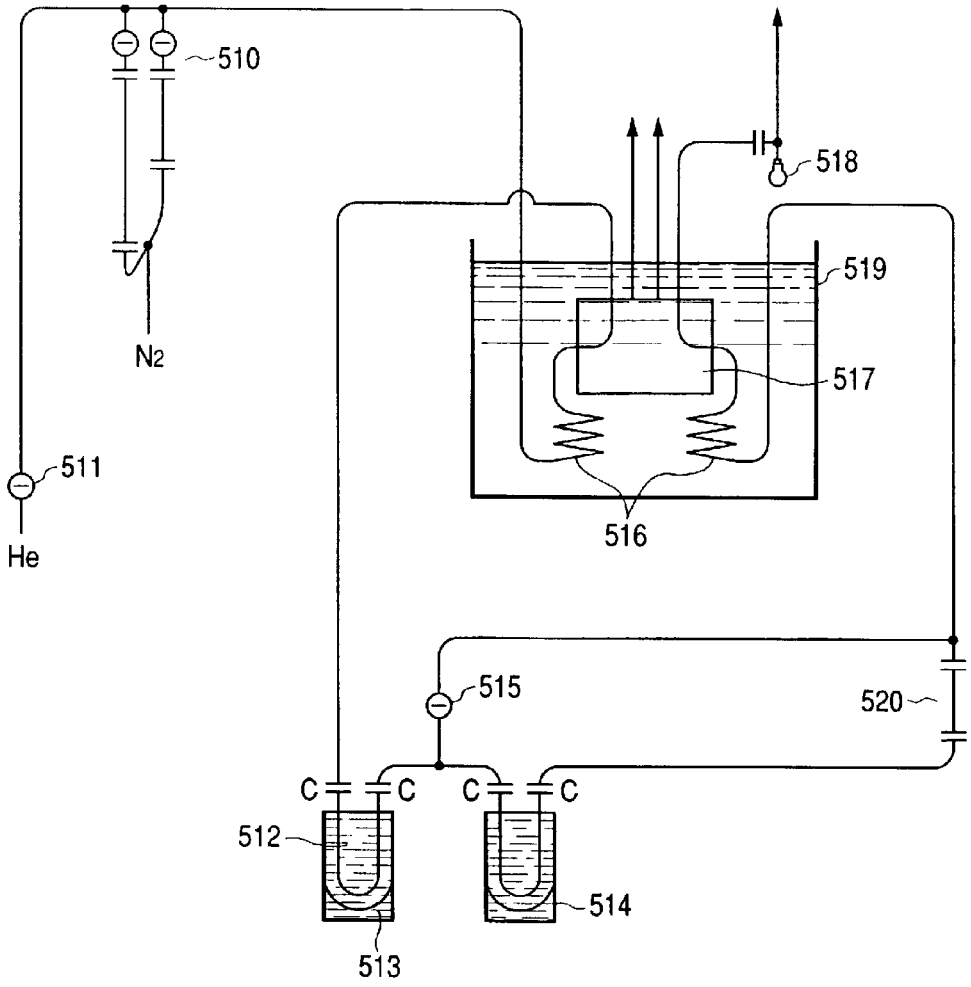
FIG. 4 is a diagrammatic view of an equipment with which the specific surface area of carbon black according to the present invention is measured.

In FIG. 4, reference numeral 512 denotes a trap; 515, a by-pass pipe; 516, temperature equilibrating coils; 517, the thermal conductivity cell; 518, a soap-film flow meter; 519, a thermostatic bath; and 520, a rotor meter.

5) A desorption curve is drawn by a recorder, and area is measured.

6) Using a calibration curve prepared by introducing a known quantity of $N_2$ prior to these steps of operation, the $N_2$ adsorption at the prescribed $P/P_0$ is found from the area obtained on the sample.

Subsequently, the specific surface area is found by applying the following equation.

$$P/v/(P_0-P)=1/vm/C+(C-1)/vm/C\cdot P/P_0$$

$P_0$: Saturated vapor pressure of adsorbate at measurement temperature.

P: Pressure at adsorption equilibrium.

v: Adsorption (quantity) at adsorption equilibrium.

C: Constant.

The relationship between $P/P_0$ and $P/v(P_0-P)$ stands a straight line, and the vm is found from its gradient and intercept. Inasmuch as the value of vm has been found, the specific surface area S is calculated from the following equation.

$$S=A\times vm\times N/W$$

S: Specific surface area.

A: Sectional area of adsorbed molecules.

N: Avogadro's number.

W: Sample quantity.

DBP Oil Absorption:

The DBP oil absorption is measured according to ASTM D2414-79. A cock of an absorptometer is operated to fill an automatic burette system completely with DBP (dibutyl phthalate) in such a way that any air bubbles remain therein. Particulars of the device are set to the following conditions.

(1) Spring tension: 2.68 kg/cm (2) Number of revolutions of rotor: 125 rpm (3) Scale on torquing limit switch: 5

(4) Damper valve: 0.150

(5) DBP dropping rate: 4 ml/min.

The rate of dropping DBP is adjusted by actual measurement, and thereafter a dry sample is put in the absorptometer in a stated quantity. A burette counter is set to the zero point, and its switch is set automatic, where the DBP is started being dropped. Once the torque reaches a preset point (which is 5 in this case), the limit switch is actuated to stop the dropping automatically, where the marking (V) on the burette counter is read. The oil absorption is calculated according to the following equation.

$$OA=100\ V/W$$

OA: Oil absorption (ml/100 g).

V: End point [the quantity (ml) of DBP used until the end point (the time at which the limit switch is actuated)].

W: Weight (g) of the dry sample.

pH Value:

1 g to 10 g of carbon black is weighed and put in a beaker, to which water is added in a proportion of 10 ml per 1 g of the sample. The beaker is covered with a watch glass, followed by boiling for 15 minutes. To make the sample wet with ease, a few drops of ethyl alcohol may be added. After the boiling, the wet sample is cooled to room temperature, and then the supernatant is removed by tilting or centrifugation to leave a mud-like matter. Electrodes of a glass electrode pH meter are inserted to this mud-like matter, and its pH is measured according to JIS Z8802 (pH-measuring method). In this case, since measurements may change depending on the position at which the electrodes are inserted, the beaker is moved to change the position of the electrodes, and the pH is measured taking care so that electrode faces come into sufficient contact with the mud-like matter. The value at which the pH value has come constant is read.

In the present invention, the carbon black may preferably be used in an amount of from 2.0 to 15% by weight, and more preferably from 5.0 to 13% by weight, based on the total weight of the toner particles. Addition of the carbon black in an amount of less than 2.0% by weight tends to cause coarse images or a decrease in image density in the visible images to be obtained. On the other hand, its addition in an amount of more than 15% by weight tends to cause spots around line images, fog and toner scatter.

Colorants of the color toners for the color developers used in the present invention may be exemplified by the following.

As yellow colorants, condensation azo compounds, isoindolinone compounds, anthraquinone compounds, azo metal complexes, methine compounds or allylamide compounds may be used. Stated specifically, C.I. Pigment Yellow 12, 13, 14, 15, 17, 62, 74, 83, 93, 94, 95, 109, 110, 111, 128, 129, 147, 168 or 180 may preferably be used. A dye such as C.I. Solvent Yellow 93, 162 or 163 may further be used in combination.

As magenta colorants, condensation azo compounds, diketopyroropyyrole compounds, anthraquinone compounds, quinacridone compounds, basic dye lake compounds, naphthol compounds, benzimidazolone compounds, thioindigo compounds or perylene compounds may be used. Stated specifically, C.I. Pigment Red 2, 3, 5, 6, 7, 23, 48:2, 48:3, 48:4, 57:1, 81:1, 144, 146, 166, 169, 177, 184, 185, 202, 206, 220, 221 or 254 may preferably be used.

As cyan colorants, copper phthalocyanine compounds and derivatives thereof, anthraquinone compounds or basic dye lake compounds may be used. Stated specifically, C.I. Pigment Blue 1, 7, 15, 15:1, 15:2, 15:3, 15:4, 60, 62 or 66 may particularly preferably be used.

These colorants may be used alone, in the form of a mixture, or in the state of a solid solution. In the present invention, the colorants are selected taking account of hue angle, chroma, brightness, weatherability, transparency on OHP films and dispersibility in toner particles. These colorants may each preferably be added in an amount of from 1 to 20 parts by weight based on 100 parts by weight of the binder resin.

As the binder resin used in the toners, the following binder resin may be used. For example, it may include, e.g., homopolymers of styrene and derivatives thereof, such as polystyrene, poly-p-chlorostyrene and polyvinyl toluene; styrene copolymers such as a styrene-p-chlorostyrene copolymer, a styrene-vinyltoluene copolymer, a styrene-vinylnaphthalene copolymer, a styrene-acrylate copolymer, a styrene-methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer and a styrene-acrylonitrile-indene copolymer; and polyvinyl chloride, phenol resins, natural-resin modified phenol resins, natural-resin modified maleic acid resins, acrylic resins, methacrylic resins, polyvinyl acetate, silicone resins, polyester resins, polyurethane resins, polyamide resins, furan resins, epoxy resins, xylene resins, polyvinyl butyral, terpene resins, cumarone indene resins, and petroleum resins. As preferred binder resins, they include styrene copolymers and polyester resins. A cross-linked styrene resin is also a preferred binder resin.

The styrene polymers or styrene copolymers may be those having been cross-linked, and may further be mixed resins of uncross-linked resins and cross-linked resins.

As a cross-linking agent for the binder resin, a compound having at least two polymerizable double bonds may be used. For example, usable are aromatic divinyl compounds such as divinyl benzene and divinyl naphthalene; carboxylic acid esters having two double bonds such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these may be used alone or in the form of a mixture.

The cross-linking agent may preferably be added in an amount of from 0.001 to 10 parts by weight based on 100 parts by weight of the polymerizable monomer used in synthesizing the binder resin.

The toners used in the present invention may each contain a charge control agent.

Those capable of controlling the toner to be negatively chargeable may include the following materials.

For example, organic metal complexes or chelate compounds are effective. Also, monoazo metal complexes, acetylacetone metal complexes, aromatic hydroxycarboxylic acids or metal compounds thereof, aromatic mono- or polycarboxylic acids or metal compounds thereof may preferably be used. They may further include phenol derivatives such as bisphenol, urea derivatives, boron compounds, quaternary ammonium salts, carixarene, silicon compounds, a styrene-acrylic acid copolymer, a styrene-methacrylic acid copolymer, and a styrene-acrylic-sulfonic acid copolymer.

Those capable of controlling the magnetic toner to be positively chargeable may include the following materials.

They may include, e.g., Nigrosine, and products modified with fatty acid metal salts; guanidine compounds; imidazole compounds; quaternary ammonium salts such as tributylbenzylammonium 1-hydroxy-4-naphthoslulfonate and tetrabutylammonium teterafluoroborate, and analogues of these, including onium salts such as phosphonium salts and lake pigments of the quaternary ammonium salts or onium salts; triphenylmethane dyes and lake pigments of these (lake-forming agents may include tungstophosphoric acid, molybdophosphoric acid, tungstomolybdophosphoric acid, tannic acid, lauric acid, gallic acid, ferricyanides and ferrocyanides); metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate. Any of these may be used alone or in combination of two or more types.

Of these, charge control agents such as Nigrosine types and quaternary ammonium salts are particularly preferably used because the rise of good charging can be achieved.

Any of these charge control agents may preferably be used in an amount of from 0.01 to 20 parts by weight, more preferably from 0.1 to 10 parts by weight, and still more preferably from 0.2 to 4 parts by weight, based on 100 parts by weight of the binder resin of the toner.

To the toners used in the present invention, a magnetic material may optionally be added. The magnetic material may preferably be one having been surface-modified. Where a magnetic toner is obtained by the polymerization toner production process, the magnetic material may preferably be surface-modified with a surface-modifying agent which is a substance having no polymerization inhibitory action to the polymerizable monomer. Such a surface-modifying agent may include, e.g., silane coupling agents and titanium coupling agents.

In the toners used in the present invention, better results are obtainable when an external additive is added as occasion calls. Such an external additive may include, e.g., fluidity improvers such as titanium oxide, silica and alumina; lubricants such as polyethylene fluoride and zinc stearate; abrasives such as cerium oxide, silicon carbide and strontium titanate; conductivity-providing agents such as carbon black and tin oxide; and fixing auxiliary agents such as low-molecular-weight polyethylene. Reverse-polarity white fine particles may also be used as a developing performance improver.

The toners used in the present invention may each preferably have a weight-average particle diameter of from 3.0 μm to 10.0 μm. If the toner has a weight-average particle diameter of more than 10.0 μm, the toner particles which develop electrostatic latent images may be so large as to make it difficult to perform development faithful to electrostatic latent images even when magnetic coated carriers are made to have a low magnetic force, and also the toner tends to scatter when toner images are electrostatically transferred. Also, a toner having a weight-average particle diameter of less than 3.0 μm may have low handling properties as powder. To measure particle size distribution of the toner, a method making use of Coulter Counter may be used, for example.

Processes for producing the toners used in the present invention are described below. The toners used in the present invention may be produced by a pulverization toner production process or a polymerization toner production process.

As the toner used in the present invention, the polymerization toner may preferably be used from the viewpoint that good transfer performance and charge quantity can be achieved and stable full-color image quality can be maintained with ease over a long period of time.

Where the pulverization toner is used in the present invention, the binder resin, the wax, the pigment, dye or magnetic material as the colorant, and optionally additives such as the charge control agent are thoroughly mixed by means of a mixing machine such as a Henschel mixer or a ball mill, and then the mixture obtained is melt-kneaded using a heat kneading machine such as a heating roll, a kneader or an extruder to make the resin components melt one another, in which the metallic compound and the colorant are dispersed or dissolved, and the kneaded product obtained is cooled to solidify, followed by pulverization and classification to obtain the toner.

The toner and any desired external additive may further optionally thoroughly be mixed by means of a mixing machine such as a Henschel mixer to obtain the toner used in the present invention.

Where the polymerization toner is used in the present invention, the toner may be produced by, e.g., the method disclosed in Japanese Patent Publication No. 56-13945, in which a molten mixture is atomized or sprayed in the air by means of a disk or multiple fluid nozzles to obtain a spherical toner; the method disclosed in Japanese Patent Publication No. 36-10231 and Japanese Patent Applications Laid-open No. 59-53856 and No. 59-61842, in which toners are directly produced by a suspension polymerization process in which a monomer composition containing at least the colorant and the wax is directly polymerized to produce toner particles; a dispersion polymerization process in which toner particles are directly produced using an aqueous organic solvent in which monomers are soluble and polymers obtained are insoluble; an emulsion polymerization process as typified by soap-free polymerization in which toner particles are produced by direct polymerization in the presence of a water-soluble polar polymerization initiator; or a hetero-agglomeration process in which primary polar emulsion polymerization particles are previously made and thereafter polar particles having reverse-polarity electric charges are added to effect association.

What is called seed polymerization may also preferably be used in the present invention, which is a process in which a monomer is further adsorbed on polymerization particles obtained first and thereafter a polymerization initiator is used to effect polymerization.

When each two-component developer is prepared by blending the toner and carrier used in the present invention, they may be blended in such a proportion that the toner in the developer is in a concentration of from 2 to 15% by weight, and preferably from 4 to 13% by weight, where good results are usually obtained. If the toner is in a concentration of less than 2% by weight, images formed may have so low a density as to make it difficult to be put into practical use. If it is in a concentration of more than 15% by weight, fog or in-machine toner scatter may greatly occur to shorten the lifetime of the developer.

In the present invention, there are no particular limitations on the method of development. Since in the developers used in the present invention the black developer and color developers are well uniformed in their transfer performance, the reversal development may be used as a preferable method in the case of a system in which the developing means serves as a substantial cleaning means, i.e., what is called a cleanerless system, in which any cleaning means for collecting the toner having remained on the electrostatic-image-bearing member after transfer is not provided between the transfer position and the development position. As to a bias applied at the time of development, its DC component may preferably be set between image-area (exposed area in the case of reverse development) potential and white-background area potential.

In the present invention, the transfer residual toner is transported from a charging means (charging assembly) having temporarily collected it to the development zone and is collected there so as to be reused, utilizing the electrostatic-image-bearing member surface. Hence, it is unnecessary to change the electrostatic-image-bearing member charging bias. However, in practical service, where the transfer material has jammed or where images having a high image percentage are continuously formed, the transfer residual toner may mix in the charging assembly in a very large quantity. In such a case, during the operation of the electrophotographic apparatus, the toner may be made to move from the charging assembly to the developing assembly, utilizing the time during which any image is not formed on the electrostatic-image-bearing member, i.e., non-image-formation time. This non-image-formation time refers to the time of forward rotation, the time of backward rotation, the transfer material intervals and so forth. In such a case, it is also preferable to change the charging bias to one by which the toner may readily move from the charging assembly to the electrostatic-image-bearing member. As a method which makes the transfer residual toner readily released from the charging assembly, the peak-to-peak voltage of an AC component may be set a little lower, or only the DC component may be applied. Also, without changing the peak-to-peak voltage, the waveform may be changed to lower the AC effective value.

In the present invention, with regard to the black developer and color developers, they have good and well uniformed transfer performance. Hence, any fog can well be kept from occurring, and the developers can be applied to the cleanerless system with ease. In particular, since any carrier contamination in a high-humidity environment can be kept from occurring and a longer lifetime can be achieved using developers in a smaller quantity, and as being preferable for making the apparatus compact, a developer-carrying member having a diameter of 20 mm or less, and preferably 16 mm or less, may preferably be used in the present invention. Also, an electrostatic-image-bearing member having a diameter of 40 mm or less, preferably 30 mm or less, and more preferably 24 mm or less, may preferably be used.

As a developing system usable in the present invention, development may be performed using a developing means making use of, e.g., a cleaner system as shown in FIG. 1. Stated specifically, the development may preferably be performed applying an alternating electric field and in such a state that a magnetic brush comes into touch with an electrostatic-image-bearing member (photosensitive drum), e.g., a photosensitive drum 1. The distance between a developer carrying member (developing sleeve) 11 and the photosensitive drum 1 (distance between S–D) may preferably be from 100 to 1,000 $\mu$m. This is favorable for preventing carrier adhesion and improving dot reproducibility. If it is smaller than 100 μm, the developer tends to be insufficiently fed, resulting in a low image density. If it is larger than 1,000 μm, the magnetic line of force from the development pole N1 may broaden to make the magnetic brush have a low density, resulting in a poor dot reproducibility, or to weaken the force of binding the carrier, tending to cause carrier adhesion.

The alternating electric field may preferably be applied at a peak-to-peak voltage of from 300 to 3,000 V and a frequency of from 500 to 10,000 Hz, and preferably from 1,000 to 7,000 Hz, which may each be applied to the process under appropriate selection. In this instance, the waveform used may variously be selected from triangular waveform, rectangular waveform, sinusoidal waveform and waveform with a varied duty ratio, and also intermittent superimposition of alternating electric fields. If the peak-to-peak voltage is lower than 300 V, a sufficient image density may be attained with difficulty, and fog toner at non-image areas cannot well be collected in some cases. If it is higher than 3,000 V, the electrostatic latent image may be disordered through the magnetic brush to cause a lowering of image quality.

Use of two-component developers having toners well charged enables application of a low fog take-off voltage (Vback), and enables the photosensitive member to be low charged in its primary charging, thus the photosensitive member can be made to have a longer lifetime. The Vback, which may depend on the development system, may preferably be 300 V or below, and more preferably 250 V or below.

As contrast potential, a potential of from 100 V to 400 V may preferably be used so that a sufficient image density can be achieved.

If the frequency is lower than 500 Hz, relating also to the process speed, the toner coming into contact with the electrostatic-image-bearing member may not well be vibrated when it is returned to the developing sleeve, so that fog tends to occur. If the frequency is higher than 10,000 Hz, the toner cannot follow up the electric field to tend to cause a lowering of image quality.

In the image-forming method of the present invention, in the formation of full-color images which attaches importance especially to halftones, the developers and developing system according to the present invention may be used especially in combination with a development system in which digital latent images are formed. Thus, the latent images are not affected by the magnetic brush and are not disordered, and hence can be developed faithfully to the dot latent images. In the transfer step, too, the use of the toner with a sharp particle size distribution from which fine powder has been cut enables achievement of a high transfer efficiency, and therefore enables achievement of a high image quality in both halftone areas and solid areas.

In addition, concurrently with the achievement of a high image quality at the initial stage, the use of the two-component type developers according to the present invention can also well bring about the effect of the present invention that any shear may less be applied to the developers in developing assemblies and no decrease in image density may occur even when copied or printed on a large number of sheets.

In order to form tighter images, development for black may finally be made in an image forming apparatus having developing assemblies for magenta, cyan, yellow and black, whereby images can more assume a tightness.

A developing system usable in the present invention is described below with reference to the accompanying drawings.

In the image forming appratus shown in FIG. 1, a charging roller 22 is brought into contact with the surface of an electrostatic-image-bearing member (photosensitive drum) 1 to charge the photosensitive drum 1 electrostatically. A charging bias is kept applied to the charging roller 22 by a bias applying means (not shown). The photosensitive drum 1 thus charged is exposed to laser light 24 by means of an exposure unit (not shown) to form a digital electrostatic image. The electrostatic image thus formed on the photosensitive drum 1 is developed with a toner 19*a* held in a developer 19 containing the toner 19*a* and carried on a developing sleeve 11 to which a development bias is kept applied by a bias applying means (not shown). Also, the developing sleeve 11 is internally provided with a magnet roller 12. Reference numeral 19*b* is a carrier contained in the developer 19.

The inside of a developing assembly 4 is partitioned into a developer chamber R1 and an agitator chamber R2 by a partition wall 17, and is provided with developer transport screws 13 and 14, respectively. At the upper part of the agitator chamber R2, a toner storage chamber R3 holding a replenishing toner 18 is formed. At the lower part of the toner storage chamber R3, a supply opening 20 is provided.

As a developer transport screw 13 is rotatingly driven, the developer held in the developer chamber R1 is transported in the longitudinal direction of the developing sleeve 11 while being agitated. The partition wall 17 is provided with openings (not shown) on this side and the inner side as viewed in the drawing. The developer transported to one side of the developer chamber R1 by the screw 13 is sent into the agitator chamber R2 through the opening on the same side of the partition wall 17, and is delivered to the developer transport screw 14. The screw 14 is rotated in the direction opposite to the screw 13. Thus, the developer in the agitator chamber R2, the developer delivered from the developer chamber R1 and the toner replenished from the toner storage chamber R3 are agitated and blended, during which the developer is transported inside the agitator chamber R2 in the direction opposite to the screw 13 and is sent into the developer chamber R1 through the opening on the other side of the partition wall 17.

To develop the electrostatic image formed on the photosensitive drum 1, the developer 19 held in the developer chamber R1 is drawn up by the magnetic force of the magnet roller 12, and is carried on the surface of the developing sleeve 11. The developer carried on the surface of the developing sleeve 11 is transported to a control blade 15 as the developing sleeve 11 is rotated, where the developer is controlled into a developer thin layer with a proper layer thickness. Thereafter, it reaches a developing zone where the developing sleeve 11 faces the photosensitive drum 1. In the magnet roller 12 at its part corresponding to the developing zone, a magnetic pole (development pole) N1 is positioned, and the development pole N1 forms a magnetic field at the developing zone. This magnetic field causes the developer to rise in ears, thus a magnetic brush of the developer is formed in the developing zone. Then, the magnetic brush comes into touch with the photosensitive drum 1. The toner attracted to the magnetic brush and the toner attracted to the surface of the developing sleeve 11 are moved to and become attracted to the region of the electrostatic image on the photosensitive drum 1, where the electrostatic image is developed, thus a toner image is formed.

The developer having passed through the developing zone is returned into the developing assembly 4 as the developing sleeve 11 is rotated, then stripped off from the developing sleeve 11 by a repulsive magnetic field formed between magnetic poles S1 and S2, and dropped into the developer chamber R1 and agitator chamber R2 so as to be collected there.

Once a T/C ratio (blend ratio of toner and carrier, i.e., toner concentration in the developer) of the developer 19 in the developing assembly 4 has lowered as a result of the above development, the toner 18 is replenished from the toner storage chamber R3 to the agitator chamber R2 in the quantity corresponding to the quantity of the toner consumed by the development, thus the T/C ratio of the developer is maintained at a prescribed value. To detect the T/C ratio of the developer 19 in the developing assembly 4, a toner concentration detecting sensor 28 is used which measures changes in permeability of the developer by utilizing the inductance of a coil. The toner concentration detecting sensor 28 has a coil (not shown) on its inside.

The developer control blade 15 provided beneath the developing sleeve 11 to control the layer thickness of the developer 19 on the developing sleeve 11 is a non-magnetic blade 15 made of a non-magnetic material such as aluminum or SUS316 stainless steel. The distance between its end and the face of the developing sleeve 11 is 200 to 900 $\mu$m, and preferably 300 to 800 $\mu$m. If this distance is smaller than 200 $\mu$m, the magnetic carrier may be caught between them to tend to make the developing layer uneven, and also the developer necessary for performing good development may be coated on the sleeve with difficulty, so that developed images with a low density and much unevenness tend to be formed. In order to prevent uneven coating (what is called the blade clog) due to unauthorized particles included in the developer, the distance may preferably be 300 $\mu$m or larger. If it is larger than 900 $\mu$m, the quantity of the developer coated on the developing sleeve 11 increases to make it difficult to make desired control of the developer layer thickness, so that the magnetic carrier particles may adhere to the photosensitive drum 1 in a large quantity and also the circulation of the developer and the control of the developer by the control blade 15 may become less effective to tend to cause fog because of a decrease in triboelectricity of the toner.

This layer of magnetic carrier particles, even when the developing sleeve 11 is rotatingly driven in the direction of an arrow, moves slower as it separates from the sleeve surface in accordance with the balance between the binding force exerted by magnetic force and gravity and the transport force acting toward the transport of the developing sleeve 11. Some particles drop by the effect of gravity.

Accordingly, the position to arrange the magnetic poles N and S and the fluidity and magnetic properties of the magnetic carrier particles may appropriately be selected, so that the magnetic carrier particle layer is transported toward the magnetic pole N1 as it stands nearer to the sleeve, to form a moving layer. Along this movement of the magnetic carrier particles, the developer is transported to the developing zone as the developing sleeve 11 is rotated, and participates in development.

The toner image formed by development is transferred onto a transfer material 25 by means of a transfer blade 27 which is a transfer means to which a transfer bias is kept applied by a bias applying means 27. The toner image thus transferred onto the transfer material is fixed to the transfer material by means of a fixing assembly (not shown). Transfer residual toner remaining on the photosensitive drum 1 without being transferred to the transfer material in the transfer step is charge-controlled in the charging step and collected at the time of development.

As the full-color image-forming method of the present invention, the developers used therein have very good transfer performance, and hence the method is suited for an image-forming apparatus of an intermediate transfer system, in particular, an image-forming apparatus having a plurality of electrostatic-image-bearing members.

An image-forming apparatus making use of a belt-shaped intermediate transfer member (hereinafter often "intermediate transfer belt") is effective as a full-color image-forming apparatus or multi-color image-forming apparatus in which a plurality of component color images based on full-color image information or multi-color image information are transferred and superimposed in sequence to obtain an image-formed matter having a full-color image or multi-color image reproduced synthetically.

Figure 2:
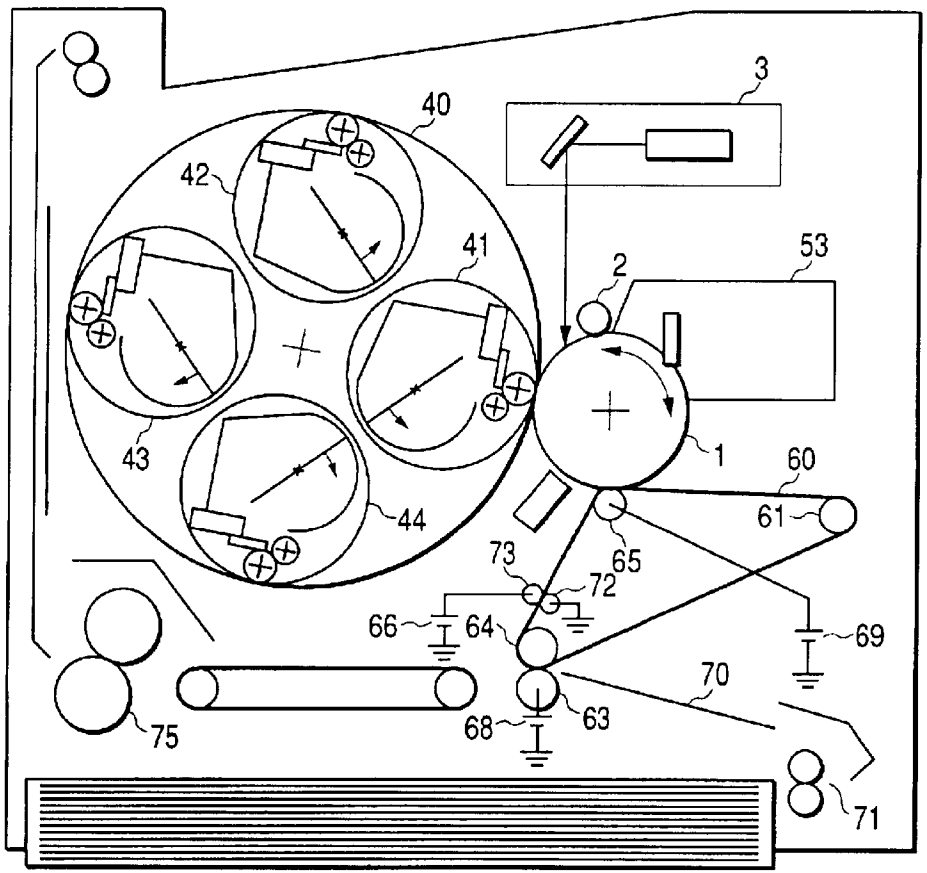
FIG. 2 is a diagrammatic view showing a preferred example of a full-color image-forming apparatus in which the full-color image-forming method of the present invention is applied.

An example of the image-forming apparatus making use of an intermediate transfer belt, preferably used in the present invention, is schematically shown in FIG. 2. This image-forming apparatus is an electrophotographic-process full-color image-forming apparatus (copying machine or laser beam printer) having an intermediate transfer belt 60. A developing assembly containing a black developer or a color developer is provided in plurality with respect to one electrostatic-image-bearing member.

The image-forming apparatus has a drum-shaped electrostatic-image-bearing member (hereinafter "photosensitive drum") 1 as a first image-bearing member. This photosensitive drum 1 is rotatingly driven at a stated peripheral speed (process speed) in the direction of an arrow.

The photosensitive drum 1 is, in the course of its rotation, uniformly electrostatically charged to stated polarity and potential by means of a primary charging assembly 2 and then subjected to imagewise exposure 3 by an imagewise exposure means, so that an electrostatic latent image is formed which corresponds to a first color component image (e.g., a yellow color component image) of an intended full-color image.

Next, the electrostatic latent image thus formed is developed by means of a first developing assembly (yellow developing assembly) 41 at the development position, and is rendered visible as a yellow toner image. At this stage, second to fourth developing assemblies, i.e., a magenta developing assembly 42, a cyan developing assembly 43 and a black developing assembly 44 are not operated and do not act on the photosensitive drum 1, and hence the yellow toner image is not influenced by the second to fourth developing assemblies 42 to 44. The first to fourth developing assemblies 41 to 44 are mounted to a support member 40 and set rotatably, and are moved in sequence toward the development position facing the photosensitive drum 1.

The intermediate transfer belt 60 is put over rollers 61, 64 and 65, and is rotatingly driven at the same peripheral speed as the photosensitive drum 1 in such direction that it moves in the same direction as the photosensitive drum 1 at the part where the former comes into contact with the latter. At the inside position of the intermediate transfer belt 60 at its part coming into contact with the photosensitive drum 1, a primary transfer roller 65 is provided and is so made that a primary transfer bias put from a bias power source 69 is applied to the intermediate transfer belt 60 via the primary transfer roller 65. The primary transfer bias has a polarity reverse to that of the toner.

The yellow toner image formed on the photosensitive drum 1 is, in the course it passes through a contact nip between the photosensitive drum 1 and the intermediate transfer belt 60, successively transferred on to the periphery of the intermediate transfer belt 60 by the aid of a primary transfer electric field formed by the primary transfer bias applied from the primary transfer roller 65 to the intermediate transfer belt 60 (primary transfer).

The photosensitive drum 1 from which the first-color yellow toner image has been transferred to the intermediate transfer belt 60 is cleaned by a cleaning unit 53 to remove any primary-transfer residual toner remaining on the surface, and thereafter used to the image formation process subsequent to the primary transfer. Subsequently, a second-color magenta toner image, a third-color cyan toner image and a fourth-color black toner image are likewise formed, and are superimposingly transferred in sequence onto the intermediate transfer belt 60, thus a synthesized color toner image corresponding to the intended full-color image is obtained. The roller 64 supporting the intermediate transfer belt 60 is a secondary transfer opposing roller, and a secondary transfer roller 63 is separably provided in contact with the outer-surface position of the intermediate transfer belt 60 at the part where this roller 64 is provided, and is so made that a secondary transfer bias is applied from a bias power source 68 to the secondary transfer roller 63. The secondary transfer roller 63 can be kept separate from the intermediate transfer belt 60 during the steps of primary transfer of the first-color to third-color toner images.

Four-color toner images transferred superimposingly onto the intermediate transfer belt 60 come close to the secondary transfer portion as the intermediate transfer belt 60 is rotated, at the timing of which the secondary transfer bias is applied from bias power source 68 to the secondary transfer roller 63 and simultaneously the secondary transfer roller 63 is brought into contact with the intermediate transfer belt 60. Also, to that contact zone, a transfer material (paper or resin sheet) P as a second image-bearing member is sent at a given timing through paper feed rollers 71, and is fed to that zone through a guide 70.

The four-color toner images on the intermediate transfer belt 60 are successively transferred at one time to the surface of the transfer material P in the course they pass through a contact nip between the intermediate transfer belt 60 and the secondary transfer roller 63, by the aid of a secondary transfer electric field formed by the secondary transfer bias applied from the secondary transfer roller 63 to the intermediate transfer belt 60 (secondary transfer). The transfer material P to which the four-color toner images have been secondarily transferred is guided into a fixing assembly 75, where it is heated and pressed, so that the four color toners are melted and color-mixed to become fixed to the transfer material P, and thus formed into a full-color copied or printed image.

The secondary-transfer residual toners having remained on the surface of the intermediate transfer belt 60 are electrostatically charged to a polarity reverse to that of the photosensitive drum 1 through a belt cleaner 73. The belt cleaner 73 comprises a roller provided separably in contact with the periphery of the intermediate transfer belt 60. It comes into contact with the surface of the intermediate transfer belt 60, and charges the secondary-transfer residual toners electrostatically to a stated polarity by applying a stated-polarity cleaning bias to the belt cleaner 73 by means of a bias power source 66, setting as the opposing pole a grounded conductive roller 72 disposed on the inside of the intermediate transfer belt 60. In this example, the photosensitive drum 1 is negatively charged, and hence the secondary-transfer residual toners are positively charged. The belt cleaner 73 can be kept separate from the intermediate transfer belt 60 during the steps of primary transfer of the first-color to third-color toner images.

The secondary-transfer residual toners charged to a reverse polarity, held on the intermediate transfer belt 60, are electrostatically attracted and moved to the photosensitive drum 1 at the part of contact of the intermediate transfer belt 60 with the photosensitive drum 1 and the vicinity thereof, and are removed from the intermediate transfer belt 60.

Compared with a system, e.g., a transfer drum system, in which a transfer material is stuck or attracted to the transfer drum surface and the toner images of the respective colors are transferred to that transfer material from the photosensitive drum 1 to obtain a full-color image, the full-color image-forming apparatus making use of the above intermediate transfer belt can transfer the toner images from the intermediate transfer belt to the transfer material without requiring any control on the transfer material (e.g., the transfer material is gripped with a gripper of a transfer drum, the transfer material is attracted to the surface of the transfer drum, or the transfer material is made to have a curvature so as to be set along the surface of the transfer drum). Hence, this apparatus has an advantage that, to obtain a full-color image, toner images can be transferred to sheets of thin paper of about 40 g/m$^2$ up to sheets of thick paper of about 200 g/m$^2$, such as envelopes, postcards, label sheets and so forth, without regard to the largeness or smallness of width and length.

Figure 3:
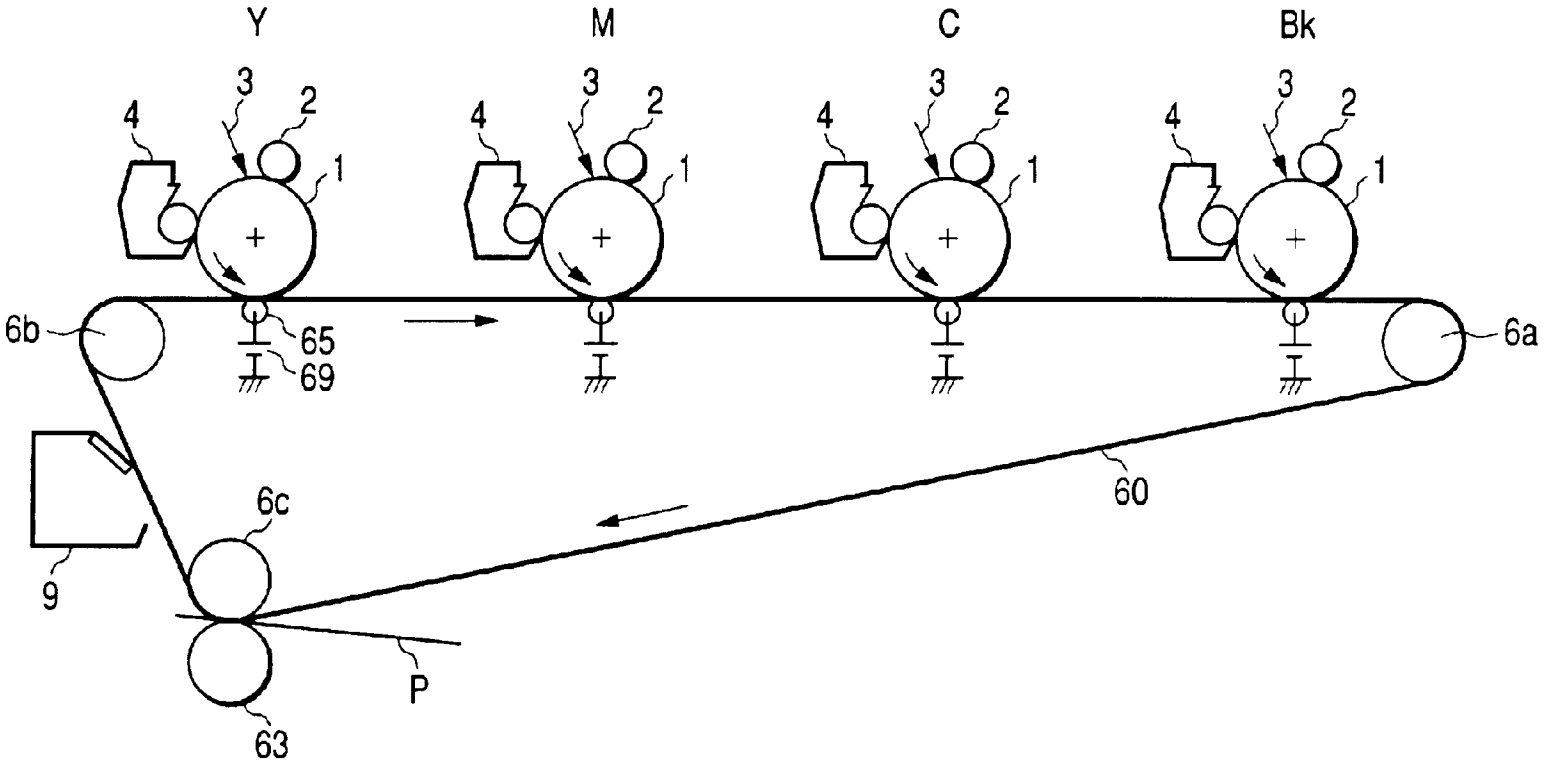
FIG. 3 is a diagrammatic view showing another preferred example of a full-color image-forming apparatus in which the full-color image-forming method of the present invention is applied.

An example of an image-forming apparatus (cleaner system) preferably usable in the full-color image-forming method of the present invention, having a plurality of electrostatic-image-bearing members, made adaptable to high-speed processing and making use of an intermediate transfer belt rich in media flexibility (the ability to deal with extensively various transfer materials including postcards up to cardboad and large-size paper) is schematically shown in FIG. 3.

FIG. 3 is a schematic sectional view of a color laser printer utilizing an electrophotographic process. It is a printer which has one developing assembly for one electrostatic-image-bearing member and in which the toner images of the respective colors, formed in sequence on a plurality of electrostatic-image-bearing members, are transferred in sequence onto an intermediate transfer member intermediate transfer belt in such a way that the toner images of the respective colors are superimposed, to form a full-color toner image on a intermediate transfer belt. In this construction, without use of the intermediate transfer member, the toner images of the respective colors, formed in sequence on a plurality of electrostatic-image-bearing members may directly be transferred in sequence onto a transfer material transported by a transport belt.

The color laser printer shown in FIG. 3 is a four-tandem drum type (in-line) printer for obtaining a full-color printed image, which has a plurality of developing assemblies and in which the toner images are first continuously multiple-transferred to a second image-bearing member intermediate transfer belt 60.

In FIG. 3, an endless intermediate transfer belt 60 is put over a drive roller 6*a*, a tension roller 6*b* and a secondary transfer opposing roller 6*c*, and is rotated in the direction of an arrow shown in the drawing.

Four developing assemblies are arranged in series along the intermediate transfer belt 60 and correspondingly to the respective colors.

An image-forming method making use of this printer is described below.

A photosensitive drum 1 disposed in a developing assembly Y which performs development with a yellow toner is, in the course of its rotation, uniformly electrostatically charged to stated polarity and potential by means of a primary charging roller 2 and then subjected to imagewise exposure 3 by an imagewise exposure means (not shown)

(e.g., an optical exposure system for color separation and image formation of color original images, or a scanning exposure system by laser scanning that outputs laser beams modulated in accordance with time-sequential electrical digital pixel signals of image information), so that an electrostatic latent image is formed which corresponds to a first color component image (e.g., a yellow color component image) of an intended full-color image.

Next, the electrostatic latent image thus formed is developed with a first-color yellow toner by means of a first developing assembly (yellow developing assembly).

In the printer shown in FIG. 3, the yellow toner image formed on the photosensitive drum 1 enters a primary transfer nip between the photosensitive drum 1 and the intermediate transfer belt 60. At this transfer nip, a flexible electrode 65 to which a voltage has been applied from a primary transfer bias power source 69 is kept in contact with the back of the intermediate transfer belt 60. The yellow toner image is first transferred to the intermediate transfer belt 60 at the first-color port. Any primary-transfer residual toner remaining on the photosensitive drum 1 is removed by a photosensitive-drum cleaner 4. Subsequently, a magenta (M) toner image, a cyan (C) toner image and a black (Bk) toner image which have been formed through the same steps as those described above are multiple-transferred in sequence at the respective ports from photosensitive drums 1 corresponding to the respective colors.

The toner images corresponding to a four-color full-color image which have been transferred onto the intermediate transfer belt 60 are then transferred to the transfer material P at one time by means of a secondary transfer roller 63, followed by fusion-fixing by means of a fixing assembly (not shown) to form a full-color printed image.

The secondary-transfer residual toner remaining on the intermediate transfer belt 60 is removed by blade cleaning with an intermediate transfer belt cleaner 9 so that the belt can prepare for the next step of transfer.

In selecting materials for the intermediate transfer belt 60, flexible materials are undesirable because good registration must be ensured at each-color port. A rubber belt of a resin type or with a metal core, or a resin-and-rubber belt, is desirable.

As the full-color image-forming method of the present invention, the developers used therein have very good transfer performance in their use over a long period of time and are stable, and hence the method is suited for an image-forming method employing the auto-refresh developing system.

Such an auto-refresh developing system usable in the present invention is described below with reference to FIG. 5.

Figure 5:
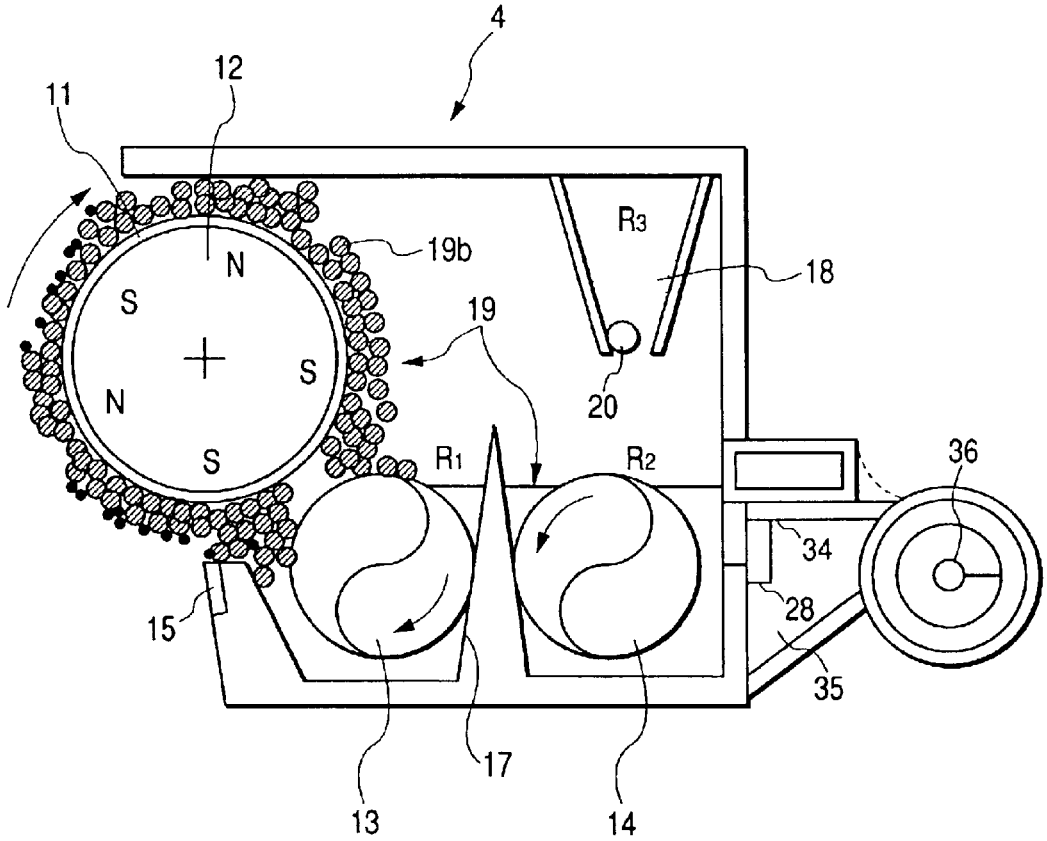
FIG. 5 is a diagrammatic view of a developing assembly employing an auto-refresh developing system.

FIG. 5 shows a developing assembly 4 provided with a developer collection section (34, 35, 36) for collecting a deteriorated developer. In a developing assembly employing the auto-refresh developing system, upon detection of a decrease in toner concentration as a result of repeated use of the developer, a replenishing developer comprising a blend of the toner and the carrier is supplied from a replenishing developer storage chamber R3 to the developing assembly 4 through a supply opening 20. The developer supplied repeatedly to become excess (chiefly a deteriorated carrier) is overflowed from a developing assembly side developer discharge opening 34 provided on the back of the developing assembly 4, and is discharged from a developer intermediate collection chamber 35 to a developer collection container (not shown) through a developer collection augered member 36.

In the present invention, where the toner and the carrier are blended to prepare the replenishing developer for use in the auto-refresh developing system, good results are obtainable when the toner and the carrier are blended in a proportion that the former is in an amount of 2 to 50 parts by weight based on 1 part by weight of the latter. Within this range of the proportion, the carrier can be made to have a charge providing ability efficiently stabilized. Particularly, as to the black developer, it is preferable to employ the auto-refresh developing system, and the black toner particles and the carrier for black developer in the replenishing black developer may be used in the proportion of the range as described above.

EXAMPLES

The present invention is specifically described below by giving Examples. The present invention is by no means limited to these.

Carrier Production Example 1

| | (by weight) |
|---|---|
| Phenol | 7.5 parts |
| Formalin solution (formaldehydeL about 40%; methanol: about 10%; the remainder: water) | 11.25 parts |
| Fine magnetite particiales lipophilic-treated with 1.0% by weight of Γ-glycidoxypropyltrimethoxysilane (average particle diameter: 0.24 vm; reisitivity: $5 \times 10^5$ • · cm | 62 parts |
| Fine $\alpha$-$Fe_2O_3$ particles lipophilic-treated with a 1.0% by weight of Γ-glicidoxypropyltrimethoxysilane (average particle diameter: 0.60 vm; reisitivity: $2 \times 10^9$ • · cm | 26 parts |

The lipophilic treatment of the magnetite and $\alpha$-$Fe_2O_3$ particles used here was carried out by adding 1.0 part by weight of γ-glycidoxypropyltrimethoxysilane to each of 99 parts by weight of magnetite and 99 parts by weight of $\alpha$-$Fe_2O_3$ particles, followed by stirring for preliminary mixing, at 100° C. for 30 minutes in a Henschel mixer.

Keeping the above materials and 11 parts by weight of water at 40° C., these were mixed for 1 hour. To the slurry thus formed, 2.0 parts by weight of 28% by weight ammonia water as a basic catalyst and 11 parts by weight of water were put into a flask. Stirring and mixing them, the temperature was raised to 85° C. over a period of 40 minutes and kept there, to carry out reaction for 3 hours to form a phenol resin, followed by curing. Thereafter, this was cooled to 30° C., followed by addition of 100 parts by weight of water. Thereafter, the supernatant liquid was removed, and the precipitate was washed with water, followed by drying. Subsequently, this was dried at 180° C. under reduced pressure (5 mmHg or less) to obtain fine-magnetite-containing spherical magnetic carrier core particles formed using the phenol resin as a binder resin.

The particles thus obtained were sieved with 60-mesh and 100-mesh sieves to remove coarse large particles, followed by removal of fine powder and coarse powder by means of a multi-division air classifier utilizing the Coanda effect (ELBOW JET LABO EJ-L-3, trade name; manufactured by Nittestu Kogyo K.K.) to obtain carrier core particles with a volume-average 50% particle diameter of 35 $\mu$m. The carrier core particles thus obtained had a resistivity of $2.2 \times 10^{12}$ Ω·cm.

Thereafter, the core particle surfaces were treated with 3% by weight of γ-aminopropyltrimethoxysilane (A) diluted with a toluene solvent under continuous application of shear stress. Here, the treatment was carried out also evaporating the solvent at 40° C. and 100 Torr and in a stream of dried nitrogen. Subsequently, the core particle surfaces thus treated were coated with a mixture of 0.5% by weight of straight silicone resin whose substituents were all methyl groups and 0.015% by weight of γ-aminopropyltrimethoxysilane (B), using toluene as a solvent. Here, the coating was carried out evaporating the solvent at 40° C. and 500 Torr and in a stream of dried nitrogen.

The resultant magnetic coated carrier was further baked at 180° C., and then sieved with a 100-mesh sieve to cut coarse large particles having agglomerated, followed by removal of fine powder and coarse powder by means of the multi-division air classifier to adjust its particle size distribution.

Thereafter, this was moisture-conditioned at 20° C./60% RH for 100 hours in a hopper kept at 23° C./60% RH to obtain a carrier 1. Physical properties of the carrier 1 thus obtained are shown in Table 1.

The physical properties are measured in the following way.

A method of measuring the charge quantity of toner and carrier is described below.

The charge quantity of toner and carrier is measured by the blow-off method.

Figure 6:
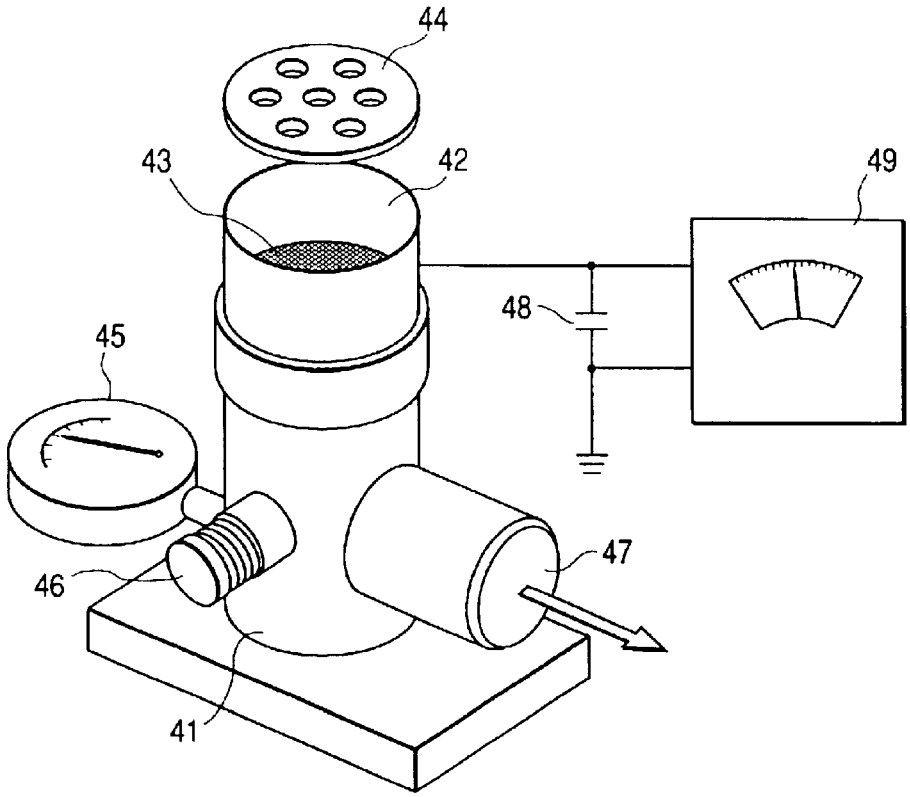
FIG. 6 is a diagrammatic view of a device with which the triboelectric charge quantity of developers is measured.

FIG. 6 illustrates a device for measuring the triboelectric charge quantity. As a measuring sample, used is one prepared by putting 1.6 g of a toner and 18.4 g of a magnetic carrier in a 50 cc bottle made of polyethylene, and leaving them for a day in an open state in a normal-temperature and normal-humidity environment (23° C./50% RH), followed by mixing for 60 seconds using a tumbler mixer. About 0.3 g [W (g)] of the sample is put in a measuring container 42 made of a metal at the bottom of which a screen 43 with a mesh of 20 μm (625 meshes) is provided, and the container is covered with a plate 44 made of a metal. Here, the total weight of the measuring container 42 is weighed and is expressed as W1 (g). Next, in a suction device 41 (made of an insulating material at least at the part coming into contact with the measuring container 42), air is sucked from a suction opening 47 and an air-flow control valve 46 is operated to control the pressure indicated by a vacuum indicator 45, to be 250 mmAq. In this state, suction is well carried out, preferably for 2 minutes, to remove the toner and the carrier by suction. The potential indicated here by a potentiometer 49 is expressed as V (volt). Herein, reference numeral 48 denotes a capacitor, whose capacitance is expressed as C (μF). The total weight of the measuring container after completion of the suction is also weighed and is expressed as W2 (g). Here, the charge quantity (mC/kg) of the toner and the carrier is calculated as shown by the following equations. Also, the values of triboelectric charge quantity shown in Table 1 are values found when measured using a polymerization cyan toner described later.

$$\text{Charge quantity (mC/kg) of toner} = (C \times V)/(W1 - W2)$$

$$\text{Charge quantity (mC/kg) of carrier} = (-C \times V)/[W - (W1 - W2)]$$

The triboelectric charge quantity of toner of the developer at the time of running is measured with the above measuring device by sampling 1 g of a developer held on the developing sleeve, and without stirring for mixing.

Carrier Production Example 2

A carrier 2 was obtained in the same manner as in Carrier Production Example 1 except that the γ-aminopropyltrimethoxysilane (A) was added in an amount changed to 5% by weight. Physical properties of the carrier 2 obtained are shown in Table 1.

Carrier Production Example 3

A carrier 3 was obtained in the same manner as in Carrier Production Example 1 except that the γ-aminopropyltrimethoxysilane (B) was added in an amount changed to 0.025% by weight. Physical properties of the carrier 3 obtained are shown in Table 1.

Carrier Production Example 4

A carrier 4 was obtained in the same manner as in Carrier Production Example 1 except that the straight silicone resin was added in an amount changed to 1.0% by weight. Physical properties of the carrier 4 obtained are shown in Table 1.

Carrier Production Example 5

A carrier 5 was obtained in the same manner as in Carrier Production Example 1 except that the proportion of the magnetite particles to the hematite particles was changed to 60:40. Physical properties of the carrier 5 obtained are shown in Table 1.

Carrier Production Example 6

A carrier 6 was obtained in the same manner as in Carrier Production Example 1 except that the magnetic coated carrier was baked at a temperature changed to 140° C. Physical properties of the carrier 6 obtained are shown in Table 1.

Carrier Production Example 7

$Fe_2O_3$, CuO and ZnO particles were so weighed as to be $Fe_2O_3$=55 mol %, CuO=25 mol % and ZnO=20 mol %, and these were mixed by means of a ball mill.

The mixture obtained was calcined, followed by pulverization by means of the ball mill, and further followed by granulation by means of a spray dryer. The granulated product was sintered and further classified to obtain magnetic ferrite coated carrier core particles. The resistivity of the magnetic ferrite coated carrier core particles obtained was measured to find that it was $2\times10^8$ Ω·cm.

Thereafter, the core particle surfaces were treated with 3% by weight of γ-aminopropyltrimethoxysilane (A) diluted with a toluene solvent under continuous application of shear stress. Here, the treatment was carried out also evaporating the solvent at 40° C. and 100 Torr and in a stream of dried nitrogen. Subsequently, the core particle surfaces thus treated were coated with a mixture of 0.5% by weight of straight silicone resin whose substituents were all methyl groups and 0.015% by weight of γ-aminopropyltrimethoxysilane (B), using toluene as a solvent. Here, the coating was carried out evaporating the solvent at 40° C. and 500 Torr and in a stream of dried nitrogen.

The resultant magnetic coated carrier was further baked at 180° C., and then sieved with a 100-mesh sieve to cut coarse large particles having agglomerated, followed by removal of fine powder and coarse powder by means of the multi-division air classifier to adjust its particle size distribution.

Thereafter, this was moisture-conditioned for 100 hours in a hopper kept at 23° C./60% RH to obtain a carrier 7. Physical properties of the carrier 7 thus obtained are shown in Table 1.

Carrier Production Example 8

A carrier 8 was obtained in the same manner as in Carrier Production Example 7 except that the γ-aminopropyltrimethoxysilane (A) was added in an amount changed to 5% by weight. Physical properties of the carrier 8 obtained are shown in Table 1.

Carrier Production Examples 9 and 10

Carriers 9 and 10 were obtained in the same manner as in Carrier Production Example 1 except that the stirring conditions were changed to make the carriers have different particle diameters. Physical properties of the carriers 9 and 10 obtained are shown in Table 1.

Carrier Production Examples 11 and 12

Carriers 11 and 12 were obtained in the same manner as in Carrier Production Example 2 except that the stirring conditions were changed to make the carriers have different particle diameters. Physical properties of the carriers 11 and 12 obtained are shown in Table 1.

Carrier Production Example 13

A carrier 13 was obtained in the same manner as in Carrier Production Example 1 except that the γ-aminopropyltrimethoxysilane (A) was changed for γ-aminopropyltriethoxysilane. Physical properties of the carrier 13 obtained are shown in Table 1.

TABLE 1

| Carrier No. | Particle diameter D50 (μm) | Magnetization intensity ($Am^2/kg$) | Resistivity (Ω · cm) | Carrier's charge quantity (mC/kg) | Toner's charge quantity (mC/kg) |
|---|---|---|---|---|---|
| 1 | 35 | 35 | $2.8 \times 10^{12}$ | 2.61 | −30 |
| 2 | 34 | 35 | $2.9 \times 10^{12}$ | 3.13 | −36 |
| 3 | 34 | 35 | $2.9 \times 10^{12}$ | 3.04 | −35 |
| 4 | 33 | 34 | $4.0 \times 10^{12}$ | 2.87 | −33 |
| 5 | 35 | 30 | $5.8 \times 10^{12}$ | 2.96 | −34 |
| 6 | 36 | 35 | $2.7 \times 10^{12}$ | 2.87 | −33 |
| 7 | 35 | 60 | $2.0 \times 10^{8}$ | 2.70 | −31 |
| 8 | 34 | 60 | $2.1 \times 10^{8}$ | 3.22 | −37 |
| 9 | 16 | 34 | $2.5 \times 10^{12}$ | 2.87 | −33 |
| 10 | 44 | 35 | $2.8 \times 10^{12}$ | 2.26 | −26 |
| 11 | 15 | 34 | $2.7 \times 10^{12}$ | 3.30 | −38 |
| 12 | 44 | 35 | $2.6 \times 10^{12}$ | 2.61 | −30 |
| 13 | 35 | 34 | $2.8 \times 10^{12}$ | 3.04 | −35 |

Toner Production Example 1

(Polymerization Cyan Toner)

In 710 parts by weight of ion-exchanged water, 450 parts by weight of an aqueous 0.1M $Na_3PO_4$ solution was introduced, followed by heating to 60° C. and then stirring at 12,000 rpm using a TK-type homomixer (manufactured by Tokushu Kika Kogyo Co., Ltd.). To the resultant mixture, 68 parts by weight of an aqueous 1.0M $CaCl_2$ solution was added little by little to obtain an aqueous medium containing $Ca_3(PO_4)_2$.

| | (by weight) |
|---|---|
| Styrene | 165 parts |
| n-Butyl acrylate | 35 parts |

-continued

| | (by weight) |
|---|---|
| C.I. Pigment Blue 15:3 (colorant) | 15 parts |
| Dialkylsalicylic acid metal compound (charge control agent) | 5 parts |
| Saturated polyester resin (polar resin) | 10 parts |
| Ester wax (melting point: 70° C.) | 50 parts |

Meanwhile, the above materials were heated to 60° C. and dissolved or dispersed uniformly by means of a TK-type homomixer (manufactured by Tokushu Kika Kogyo Co., Ltd.) at 11,000 rpm. To the mixture obtained, 10 parts by weight of a polymerization initiator 2,2'-azobis(2,4-dimethylvaleronitrile) were dissolved to prepare a polymerizable monomer composition.

The polymerizable monomer composition was introduced in the above aqueous medium, followed by stirring for 10 minutes at 60° C. in an atmosphere of nitrogen, using the TK-type homomixer at 11,000 rpm to granulate the polymerizable monomer composition. Thereafter, the granulated product obtained was stirred with a paddle stirring blade during which the temperature was raised to 80° C., where the reaction was carried out for 10 hours. After the polymerization was completed, residual monomers were evaporated off under reduced pressure, the reaction system was cooled, and thereafter hydrochloric acid was added thereto to dissolve the calcium phosphate, followed by filtration, washing and then drying to obtain cyan toner particles.

To 100 parts by weight of the cyan toner particles thus obtained, 1.6 parts by weight of hydrophobic-treated fine silica powder (number-average particle diameter of primary particles: 0.03 μm) were externally added to obtain a polymerization cyan toner with a weight-average particle diameter of 6.8 μm.

A specific example of how to measure toner's particle diameter is shown below.

To 100 to 150 ml of an electrolytic solution, 0.1 to 5 ml of a surface active agent (an alkylbenzene sulfonate) is added, and 2 to 20 mg of a sample to be measured is added thereto. The electrolytic solution in which the sample has been suspended is subjected to dispersion for 1 to 3 minutes by means of an ultrasonic dispersion machine. Particle size distribution and so forth of particles of 0.3 to 40 μm in diameter are measured on the basis of volume by means of Coulter Coulter Multisizer (trade name; manufactured by Coulter Electronics, Inc.), using an aperture adjusted to appropriate toner size such as 17 μm or 100 μm. Number-average particle diameter and weight-average particle diameter measured under these conditions are determined by computer processing.

Toner Production Example 2

(Polymerization Magenta Toner)

A polymerization magenta toner with a weight-average particle diameter of 6.8 μm was obtained in the same manner as in Toner Production Example 1 except that, in place of the Pigment Blue used therein, quinacridone was used in an amount of 8 parts by weight.

Toner Production Example 3

(Polymerization Yellow Toner)

A polymerization yellow toner with a weight-average particle diameter of 6.8 μm was obtained in the same manner as in Toner Production Example 1 except that, in place of the Pigment Blue used therein, C.I. Pigment Yellow 93 was used in an amount of 6.5 parts by weight.

Toner Production Example 4

(Polymerization Black Toner 1)

A polymerization black toner 1 with a weight-average particle diameter of 6.9 μm was obtained in the same manner as in Toner Production Example 1 except that, in place of the Pigment Blue used therein, carbon black having an average primary particle diameter of 30 nm, a specific surface area of from 150 $m^2/g$ and a DBP oil absorption of 48 ml/100 g was used.

Toner Production Example 5

(Pulverization Cyan Toner)

| | (by weight) |
|---|---|
| Polyester resin (condensation polymer of propoxylated bisphenol A with fumeric acid; acid value: 10.8 mg.KOH/g | 100 parts |
| C.I. Pigment Blue 15:3 | 5 parts |
| Aluminum compound of dialkylsalicylic acid | 5 parts |
| Low-molecular-weight polypropylene | 5 parts |

The above materials were mixed by means of a Henschel mixer, and, sucking from its vent port connected to a suction pump, the mixture formed was melt-kneaded using a twin-extruder. The melt-kneaded product thus obtained was cooled and then crushed by means of a hammer mill to obtain a 1 mm mesh-pass crushed product. The crushed product was further pulverized by means of a jet mill, followed by classification using a multi-division classifier (Elbow Jet) to obtain cyan toner particles.

To 100 parts by weight of the cyan toner particles thus obtained, 1.2 parts by weight of hydrophobic-treated fine titanium oxide powder (number-average particle diameter of primary particles: 0.02 μm) were added, followed by mixing by means of a Henschel mixer to obtain a pulverization cyan toner with a weight-average particle diameter of 6.5 μm.

Toner Production Example 6

(Pulverization Magenta Toner)

A pulverization magenta toner with a weight-average particle diameter of 6.8 μm was obtained in the same manner as in Toner Production Example 5 except that, in place of the Pigment Blue used therein, quinacridone was used.

Toner Production Example 7

(Pulverization Yellow Toner)

A pulverization yellow toner with a weight-average particle diameter of 6.7 μm was obtained in the same manner as in Toner Production Example 5 except that, in place of the Pigment Blue used therein, C.I. Pigment Yellow 93 was used.

Toner Production Example 8

(Pulverization Black Toner)

A pulverization black toner with a weight-average particle diameter of 7.0 μm was obtained in the same manner as in Toner Production Example 5 except that, in place of the Pigment Blue used therein, the carbon black used in Toner Production Example 4 was used.

Toner Production Example 9

(Polymerization Black Toner 2)

A polymerization black toner 2 with a weight-average particle diameter of 6.8 μm was obtained in the same manner as in Toner Production Example 1 except that, in place of the Pigment Blue used therein, C.I. Pigment Yellow 17, C.I. Pigment Red 5 and C.I. Pigment Blue 15:3 were used in amounts of 2.4 parts by weight, 6 parts by weight and 3.6 parts by weight, respectively.

Example 1

The carrier 1 and the polymerization yellow toner, polymerization magenta toner and polymerization cyan toner each, and the carrier 2 and the polymerization black toner 1, were respectively so blended that each toner is in a content of 8% by weight based on total weight, to obtain four-color two-component developers.

Using the four-color two-component developers thus obtained and using a commercially available copying machine CLC500 (manufactured by CANON INC.) remodeled into the image-forming apparatus having an intermediate transfer member as shown in FIG. 2, an original image having an image duty (image area percentage) of 5% was copied on 40,000 sheets, and evaluation was made on transfer efficiency, charge stability, toner scatter, fog, and image uniformity. Results obtained are shown in Tables 3 and 4. Measurement conditions and evaluation criteria for the respective items are shown below.

The evaluation test was made in an environment of high temperature and high humidity (H/H: 32.5° C./90% RH). As copying sheets, Color Laser Copyer SK Paper (available from CANON INC.) having been moisture-conditioned for 24 hours in an environment of high temperature and high humidity (H/H: 32.5° C./90% RH) was used.

Transfer Efficiency:

An evaluation test was made in the following way: First, solid monochromatic toner images were formed for each color on the electrostatic-image-bearing member, and the solid monochromatic toner images for each color were collected with a transparent pressure-sensitive adhesive tape. Their image density (D1) was measured with a color reflection densitometer X-RITE 404A, trade name, manufactured by X-Rite Co. Next, the solid monochromatic toner images were again formed for each color on the electrostatic-image-bearing member, and were transferred to the intermediate transfer member and the transfer material successively. The solid monochromatic toner images having been transferred to the transfer material were each collected with a transparent pressure-sensitive adhesive tape, and its image density (D2) was measured. The transfer efficiency was calculated from the image densities (D1) and (D2) thus measured, according to the following equation. Toner images where four-color halftone toner images were superimposed were also formed and collected in the same way, and their transfer efficiency was calculated by the same method.

$$\text{Transfer efficiency (\%)}=(D2/D1)\times 100$$

Charge Stability:

As to the charge stability, a 40,000-sheet copying test was made in each environment. The charge stability was evaluated by any change in charge quantity of the developer for each color. For evaluation, the change width between charge quantity at the time of copying on the 1,000th sheet and charge quantity at the time of finish of the test was expressed in "%" on the basis of the charge quantity of toner at the initial stage. Evaluation was made according to the following criteria.

(Evaluation Criteria)

A: The change width of charge quantity is 0% to less than 11%.

B: The change width of charge quantity is 11% to less than 21%.

C: The change width of charge quantity is 21% to less than 31%.

D: The change width of charge quantity is 31% or more.

Toner Scatter:

As to the toner scatter, the developing assemblies were each taken out after the image reproduction on 40,000 sheets, and set in a blank rotating machine. A sheet of A4-size was placed right beneath the sleeve of the developing assembly, and the sleeve was blank-rotated for 10 minutes, where the weight of the toner dropped on the paper was measured. Evaluation was made according to the following criteria.

(Evaluation Criteria)

A: Less than 4 mg.

B: 4 mg to less than 7 mg.

C: 7 mg to less than 10 mg.

D: 10 mg or more.

Fog:

With regard to the fog, the reflection density of white paper and the reflection density of non-image areas of paper on which images were reproduced using the copying machine were measured with a reflection densitometer TC6MC, manufactured by Tokyo Denshoku Technical Center, in each environment. The difference in reflection density between the both was examined on the basis of the reflection density of white paper, and what showed the worst fog among the four colors was expressed according to the following evaluation criteria.

(Evaluation Criteria)

A: Less than 0.6%.

B: 0.6% to less than 1.1%.

C: 1.1% to less than 1.6%.

D: 1.6% to less than 2.1%.

E: 2.1% to less than 4.1%.

F: 4.1% or more.

Image Uniformity, Image Quality:

Solid monochromatic images and four-color halftone image superimposed images were printed, and their image uniformity was visually evaluated according to the following evaluation criteria.

A: Images are uniform, and any uneven image does not appear.

B: Uneven images are a little seen, but on a level not problematic at all in practical use.

C: Uneven images are a little seen, but on a level tolerable in practical use.

D: Uneven images appear greatly.

Examples 2 to 5

Images were reproduced and evaluated in the same manner as in Example 1 except that the combination of the carriers with the toners was changed as shown in Table 2. The results of evaluation are shown in Tables 3 and 4. As shown in Tables 3 and 4, good results were obtained in each evaluation.

Comparative Example 1

Images were reproduced and evaluated in the same manner as in Example 1 except that the carrier for the black developer was changed to the carrier 1 as shown in Table 2. The results of evaluation are shown in Tables 3 and 4.

The transfer efficiency of black and four-color superimposed toner images, the toner scatter, the fog, the image uniformity of black and four-color superimposed images and the charge stability of black developer turned for the worse after the image reproduction on 40,000 sheets. This is considered due to the fact that the charge-providing ability of the carrier for the black developer was the same as that of the carriers for the color developers, and hence it was not able to keep the transfer performance from lowering with a decrease in charge quantity, what is most aimed at in the present invention, so that the developing performance and transfer performance of the black developer and those of the color developers came to differ greatly with a deterioration of developers because of their use over a long period of time.

Example 6

Images were reproduced and evaluated in the same manner as in Example 1 except that the polymerization toner was changed to the pulverization toner as shown in Table 2. The results of evaluation are shown in Tables 3 and 4. As shown in Tables 3 and 4, good results were obtained in each evaluation.

Comparative Example 2

Images were reproduced and evaluated in the same manner as in Example 1 except that the carrier for the black developer was changed to the carrier 1 and also the polymerization toner was changed to the pulverization toner as shown in Table 2. The results of evaluation are shown in Tables 3 and 4.

As shown in Tables 3 and 4, the results turned for the worse in all evaluation items after the image reproduction on 40,000 sheets. This is considered due to the fact that, like the results in Comparative Example 1, the charge-providing ability of the carrier for the black developer was the same as that of the carriers for the color developers, and hence it was not able to keep the transfer performance from lowering with a decrease in charge quantity, what is most aimed at in the present invention, so that the developing performance and transfer performance of the black developer and those of the color developers came to differ greatly with a deterioration of developers because of the deterioration of the developers after their use over a long period of time. The above is further considered due to the fact that the pulverization toners were used, having a broad particle size distribution and a great strain due to shape as compared with the polymerization toner, and hence the toners deteriorated greatly to come to have an unstable chargeability because of their use over a long period of time.

Example 7

Images were reproduced and evaluated in the same manner as in Example 1 except that the carrier 1 was changed to the carrier 7, and the carrier 2 to the carrier 8, as shown in Table 2. The results of evaluation are shown in Tables 3 and 4.

As shown in Tables 3 and 4, good results were obtained in each evaluation. In all evaluation items, the results are a little inferior to those in Example 1. This is presumed due to the fact that the ferrite carriers had a larger true specific gravity and also had a little greater strain due to shape of particles and a broader particle size distribution, than the polymerization magnetic-fine-particle-dispersed resin carriers, and hence the charge distribution was so broad that they deteriorated earlier during their use over a long period of time.

Example 8

Images were reproduced and evaluated in the same manner as in Example 1 except that, in place of the image-forming apparatus used therein, a commercially available copying machine CP2120 (manufactured by CANON INC.) was remodeled to have the construction as shown in FIG. 3 and an image-forming apparatus having such construction was used. The results of evaluation are shown in Tables 3 and 4. As shown in Tables 3 and 4, good results were obtained in each evaluation.

Examples 9 and 10

Images were reproduced and evaluated in the same manner as in Example 1 except that the carriers were changed to those having different particle diameter, as shown in Table 2. The results of evaluation are shown in Tables 3 and 4.

Comparative Example 3

Images were reproduced and evaluated in the same manner as in Example 1 except that the black toner was changed to the polymerization black toner 2 as shown in Table 2. The results of evaluation are shown in Tables 3 and 4.

As shown in Tables 3 and 4, the fog, charge stability and so forth of the black toner turned for the worse after the image reproduction on 40,000 sheets. This is presumed due to the fact that organic colorants were used in place of the carbon black and the organic colorants were used in large quantities in order to achieve substantially the same image density as in the case of use of the carbon black, so that they had poor environmental properties.

Example 11

Images were reproduced and evaluated in the same manner as in Example 1 except that the carrier 2 was changed to the carrier 13 as shown in Table 2. The results of evaluation are shown in Tables 3 and 4. As shown in Tables 3 and 4, good results were obtained in each evaluation.

Example 12

Images were reproduced and evaluated in the same manner as in Example 1 except that, in place of the image-forming apparatus used therein, a commercially available copying machine CP2120 (manufactured by CANON INC.) was used, having such construction that, in the image-forming apparatus shown in FIG. 3, a transfer material transport belt was used in place of the intermediate transfer belt 60 and the transfer material was transported by the transport belt so that the toner images were directly transferred in sequence from the photosensitive drums to the transfer material. The results of evaluation are shown in Tables 3 and 4.

Example 13

In Example 1, the image-forming apparatus was remodeled to have developing assemblies of the auto-refresh developing system, and images were reproduced on 300,000 sheets using replenishing developers for the respective colors, containing 15% of the carriers according to the present invention. Each evaluation was made in the same manner as in Example 1. The results of evaluation are shown in Tables 3 and 4.

Example 14

In Example 12, the image-forming apparatus was remodeled to have developing assemblies of the auto-refresh developing system, and images were reproduced on 300,000 sheets using replenishing developers for the respective colors, containing 15% of the carriers according to the present invention. Each evaluation was made in the same manner as in Example 1. The results of evaluation are shown in Tables 3 and 4.

TABLE 2

| | Carriers for color developers | Carrier for black developer | Yellow toner | Magenta toner | Cyan toner | Black toner |
|---|---|---|---|---|---|---|
| Example: | | | | | | |
| 1 | Carrier 1 | Carrier 2 | Polymerization | Polymerization | Polymerization | Polymerizn 1 |
| 2 | Carrier 1 | Carrier 3 | Polymerization | Polymerization | Polymerization | Polymerizn 1 |
| 3 | Carrier 1 | Carrier 4 | Polymerization | Polymerization | Polymerization | Polymerizn 1 |
| 4 | Carrier 1 | Carrier 5 | Polymerization | Polymerization | Polymerization | Polymerizn 1 |
| 5 | Carrier 1 | Carrier 6 | Polymerization | Polymerization | Polymerization | Polymerizn 1 |
| Comparative Example: | | | | | | |
| 1 | Carrier 1 | Carrier 1 | Polymerization | Polymerization | Polymerization | Polymerizn 1 |
| Example: | | | | | | |
| 6 | Carrier 1 | Carrier 2 | Pulverization | Pulverization | Pulverization | Pulverization |
| Comparative Example: | | | | | | |
| 2 | Carrier 1 | Carrier 1 | Pulverization | Pulverization | Pulverization | Pulverization |
| Example: | | | | | | |
| 7 | Carrier 7 | Carrier 8 | Polymerization | Polymerization | Polymerization | Polymerizn 1 |
| 8 | Carrier 1 | Carrier 2 | Polymerization | Polymerization | Polymerization | Polymerizn 1 |
| 9 | Carrier 9 | Carrier 11 | Polymerization | Polymerization | Polymerization | Polymerizn 1 |
| 10 | Carrier 10 | Carrier 12 | Polymerization | Polymerization | Polymerization | Polymerizn 1 |
| Comparative Example: | | | | | | |
| 3 | Carrier 1 | Carrier 2 | Polymerization | Polymerization | Polymerization | Polymerizn 2 |
| Example: | | | | | | |
| 11 | Carrier 1 | Carrier 13 | Polymerization | Polymerization | Polymerization | Polymerizn 1 |

TABLE 2-continued

| | Carriers for color developers | Carrier for black developer | Yellow toner | Magenta toner | Cyan toner | Black toner |
|---|---|---|---|---|---|---|
| 12 | Carrier 1 | Carrier 2 | Polymerization | Polymerization | Polymerization | Polymerizn 1 |
| 13 | Carrier 1 | Carrier 2 | Polymerization | Polymerization | Polymerization | Polymerizn 1 |
| 14 | Carrier 1 | Carrier 2 | Polymerization | Polymerization | Polymerization | Polymerizn 1 |

TABLE 3

| | Initial stage (after 10 sheets)/ after running on 40,000 sheets (after 300,000 sheets in Examples 13, 14) | | | | | | | | | | |
|---|---|---|---|---|---|---|---|---|---|---|---|
| | Transfer efficiency (%) | | | | | | Image uniformity (image quality) | | | | |
| | Yellow | Magenta | Cyan | Black | Four colors | Fog | Yellow | Magenta | Cyan | Black | Four colors |
| Example: | | | | | | | | | | | |
| 1 | 95/93 | 94/93 | 94/92 | 95/92 | 94/91 | A/A | A/A | A/A | A/A | A/A | A/A |
| 2 | 95/93 | 94/93 | 94/92 | 94/93 | 93/91 | A/A | A/A | A/A | A/A | A/A | A/A |
| 3 | 95/93 | 94/93 | 94/92 | 92/90 | 93/89 | A/B | A/A | A/A | A/A | A/B | A/B |
| 4 | 95/93 | 94/93 | 94/92 | 93/90 | 92/90 | A/B | A/A | A/A | A/A | A/B | A/B |
| 5 | 95/93 | 94/93 | 94/92 | 92/90 | 93/89 | A/B | A/A | A/A | A/A | A/B | A/B |
| Comparative Example: | | | | | | | | | | | |
| 1 | 95/93 | 94/93 | 94/92 | 87/82 | 82/75 | B/E | A/A | A/A | A/A | B/C | B/D |
| Example: | | | | | | | | | | | |
| 6 | 91/89 | 92/89 | 91/90 | 92/89 | 91/88 | A/B | A/B | A/B | A/B | A/B | A/B |
| Comparative Example: | | | | | | | | | | | |
| 2 | 91/89 | 92/89 | 91/90 | 85/79 | 79/72 | C/F | A/B | A/B | A/B | B/C | B/D |
| Example: | | | | | | | | | | | |
| 7 | 90/88 | 91/89 | 90/88 | 90/88 | 90/87 | A/B | A/B | A/B | A/B | A/B | A/B |
| 8 | 95/92 | 94/92 | 94/93 | 94/91 | 93/90 | A/B | A/A | A/A | A/A | A/A | A/A |
| 9 | 90/88 | 90/89 | 90/88 | 89/87 | 88/86 | B/C | B/B | B/B | B/B | B/B | B/B |
| 10 | 91/89 | 90/88 | 91/88 | 89/87 | 88/86 | B/B | B/B | B/B | B/B | B/B | B/B |
| Comparative Example: | | | | | | | | | | | |
| 3 | 95/93 | 94/93 | 94/92 | 93/90 | 92/90 | B/C | B/A | B/A | B/A | B/C | B/C |
| Example: | | | | | | | | | | | |
| 11 | 95/93 | 94/93 | 94/92 | 95/91 | 94/91 | A/A | A/A | A/A | A/A | A/A | A/A |
| 12 | 94/94 | 94/93 | 94/93 | 94/93 | 93/92 | A/A | A/A | A/A | A/A | A/A | A/A |
| 13 | 95/93 | 94/92 | 94/93 | 95/92 | 94/91 | A/B | A/B | A/B | A/B | A/B | A/B |
| 14 | 95/92 | 94/92 | 94/92 | 95/91 | 94/90 | A/B | A/B | A/B | A/B | A/B | A/B |

TABLE 4

| | After running on 40,000 sheets (after 300,000 sheets in Examples 13, 14) | |
|---|---|---|
| | Toner scatter | Charge stability (yellow/magenta/cyan/black) |
| Example: | | |
| 1 | A | A/A/A/A |
| 2 | A | A/A/A/A |
| 3 | B | A/A/A/B |
| 4 | B | A/A/A/B |
| 5 | B | A/A/A/B |
| Comparative Example: | | |
| 1 | E | A/A/A/C |
| Example: | | |
| 6 | B | B/B/B/B |
| Comparative Example: | | |
| 2 | F | B/B/B/D |
| Example: | | |
| 7 | B | B/B/B/B |
| 8 | B | A/A/A/A |
| 9 | B | B/B/B/C |

TABLE 4-continued

| | After running on 40,000 sheets (after 300,000 sheets in Examples 13, 14) | |
|---|---|---|
| | Toner scatter | Charge stability (yellow/magenta/cyan/black) |
| 10 | C | B/B/B/C |
| Comparative Example: | | |
| 3 | C | A/A/A/C |
| Example: | | |
| 11 | A | A/A/A/A |
| 12 | A | A/A/A/A |
| 13 | B | B/B/B/B |
| 14 | B | B/B/B/B |

What is claimed is:

1. A full-color image-forming method comprising:

a charging step of charging an electrostatic-image-bearing member electrostatically;

a latent-image-forming step of forming an electrostatic latent image on the electrostatic-image-bearing member having been charged;

a developing step of developing the electrostatic latent image by the use of a developer held in a developing assembly, to form a toner image;

a transfer step of transferring to a transfer material the toner image having been formed; and a fixing step of fixing the toner image to the transfer material, said developer used in said developing step comprising a plurality of color developers and a black developer, said color developers being each a two-component developer for full-color image formation which has i) a color toner having color toner particles containing at least a binder resin, a colorant and a wax and ii) a carrier for the color developer, said black developer being a two-component developer for full-color image formation which has i) a black toner having black toner particles containing at least a binder resin, carbon black and a wax and ii) a carrier for the black developer, each of said color toners and said black toner are charged with the same polarity in said developing step, and said carrier for the black developer having a larger absolute value of charge quantity when the same toner is used, than the respective carriers for the color developers.

2. The full-color image-forming method according to claim 1, wherein a plurality of developing assemblies holding the black developer and the color developers are used for one electrostatic-image-bearing member.

3. The full-color image-forming method according to claim 2, wherein toner images of a plurality of colors are superimposed on said electrostatic-image-bearing member to form a multiple toner image, and the multiple toner image is transferred to a transfer material via, or not via, an intermediate transfer member.

4. The full-color image-forming method according to claim 2, wherein the toner image is transferred to an intermediate transfer member every time the developing step for forming a toner image of each color is carried out, to form toner images of a plurality of colors superimposingly on the intermediate transfer member.

5. The full-color image-forming method according to claim 2, wherein the toner image is transferred to a transfer material every time the developing step for forming a toner image of each color is carried out, to form toner images of a plurality of colors superimposingly on the transfer member.

6. The full-color image-forming method according to claim 1, wherein one developing assembly is used for one electrostatic-image-bearing member, and a plurality of toner images formed in sequence on a plurality of electrostatic-image-bearing members are transferred in sequence onto an intermediate transfer member or a transfer material in such a way that the toner images are superimposed.

7. The full-color image-forming method according to claim 1, wherein a yellow developer, a magenta developer and a cyan developer are used as said color developers.

8. The full-color image-forming method according to claim 1, wherein the particle surfaces of said carriers for the color developers and said carrier for the black developer have been treated with at least one of i) a resin having an amino group, ii) a coupling agent having an amino group and iii) a resin containing a coupling agent having an amino group.

9. The full-color image-forming method according to claim 1, wherein the particle surfaces of said carriers for the color developers and said carrier for the black developer have been treated with at least one of a silane coupling agent having an amino group and a resin containing a silane coupling agent having an amino group, and the amount of surface treatment with at least one of the silane coupling agent having an amino group and the resin containing a silane coupling agent having an amino group is larger in the carrier for the black developer than the carriers for the color developers.

10. The full-color image-forming method according to claim 1, wherein said carriers for the color developers and said carrier for the black developer each have magnetic-fine-particle-dispersed resin carrier cores obtained by a polymerization process comprising magnetic fine particles and a binder resin.

11. The full-color image-forming method according to claim 1, wherein said carriers for the color developers and said carrier for the black developer each have a volume-based 50% particle diameter D50 of from 15 $\mu$m to 45 $\mu$m.

12. The full-color image-forming method according to claim 1, wherein said black toner particles contain the wax in a quantity larger than said color toner particles.

13. The full-color image-forming method according to claim 1, wherein said black toner and said color toners each have a weight-average particle diameter of from 3.0 $\mu$m to 10.0 $\mu$m, and each contain the wax in an amount of from 2 parts by weight to 30 parts by weight based on 100 parts by weight of the binder resin.

14. The full-color image-forming method according to claim 1, wherein said black toner and said color toners each have a weight-average particle diameter of from 3.0 $\mu$m to 10.0 $\mu$m, and each contain the wax in an amount of from 11.5 parts by weight to 20 parts by weight based on 100 parts by weight of the binder resin.

15. The full-color image-forming method according to claim 1, wherein said black toner particles and said color toner particles are toner particles produced by a polymerization process.

16. The full-color image-forming method according to claim 1, wherein, when the developers are replenished, developers containing carriers are replenished.

17. The full-color image-forming method according to claim 1, wherein, when the black developer is replenished, a replenishing black developer containing black toner particles and a carrier for the black developer is replenished.

18. The full-color image-forming method according to claim 17, wherein said replenishing black developer contains the black toner particles in a proportion of from 2 parts by weight to 50 parts by weight based on 1 part by weight of the carrier for the black developer.

19. A two-component developer kit comprising:

a plurality of color developers; and a black developer, said color developers being each a two-component developer for full-color image formation which has i) a color toner having color toner particles containing at least a binder resin, a colorant and a wax and ii) a carrier for the color developer, said black developer being a two-component developer for full-color image formation which has i) a black toner having black toner particles containing at least a binder resin, carbon black and a wax and ii) a carrier for the black developer, each of said color toners and said black toner are charged with the same polarity in a developing step, and said carrier for the black developer having a larger absolute value of charge quantity when the same toner is used, than the respective carriers for the color developers.

* * * * *

UNITED STATES PATENT AND TRADEMARK OFFICE

CERTIFICATE OF CORRECTION

PATENT NO. : 6,855,469 B2
DATED : February 15, 2005
INVENTOR(S) : Ikeda et al.

It is certified that error appears in the above-identified patent and that said Letters Patent is hereby corrected as shown below:

Title page,
Item [56], References Cited, U.S. PATENT DOCUMENTS, insert:
-- 6,096,466 8/2000 Imai et al 430/108 --.
FOREIGN PATENT DOCUMENTS, insert:
-- EP 0 999 478 5/2000
EP 0 606 100 7/1994 --.

Column 2,
Line 59, “more tends” should read -- tends more --.
Line 63, “in respect of” should read -- with respect to --.

Column 3,
Line 2, “toner to tend” should read -- toner’s tendency --.
Line 39, “ration” should read -- rating --.

Column 6,
Line 17, “simply” should read -- simply referred to as --.
Line 20, “in respect of” should read -- with respect to --.

Column 7,
Line 46, “in” should read -- with --.
Line 47, “of” should read -- to --.

Column 10,
Line 6, “concerned” should read -- a concern --.
Line 18, “is” should read -- are --.

Column 13,
Line 4, “in which” should read -- in which, --.
Line 5, “uniformly” should read -- uniformly, --.

Column 15,
Line 23, “isoporpyl” should read -- isopropyl --.

Column 20,
Line 14, “--4-naphthoslulfonate” should read -- 4-naphthosulfonate --.
Line 15, “teterafluoroborate” should read -- tetrafluoroborate --.

Column 23,
Lines 18 and 35, “well be” should read -- be well --.
Line 57, “less be” should read -- be less --.

UNITED STATES PATENT AND TRADEMARK OFFICE

CERTIFICATE OF CORRECTION

PATENT NO. : 6,855,469 B2
DATED : February 15, 2005
INVENTOR(S) : Ikeda et al.

It is certified that error appears in the above-identified patent and that said Letters Patent is hereby corrected as shown below:

Column 26,
Line 6, “often” should read -- often referred to as --.
Line 23, “(hereinafter” should read -- (hereinafter referred to as --.

Column 30,
Line 25, “(formaldehydeL” should read -- (formaldehyde: --.
Line 27, “particiales” should read -- particles --.
Line 28, “Γ-” should read -- γ- --.
Lines 29 and 33, “vm; reisitivity:” should read -- μm; resistivity: --.
Line 30, “5 x $10^5$ • cm” should read -- 5 x $10^5$ Ω • cm --.
Line 32, “Γ-glicidoxypropyltrimethoxysilane” should read
-- Γ-glycidoxypropyltrimethoxysilane --.
Line 34, “2 x $10^9$ • cm” should read -- 2 x $10^9$ Ω • cm --.

Column 34,
Line 47, “Coulter” (second occurrence) should be deleted.

Column 36,
Line 16, “is” should read -- was --.
Line 32, “Copyer” should read -- Copier --.

Column 37,
Lines 51 and 53, “a little seen,” should read -- seen a little, --.

Column 40,
Table 2, “Polymerizn” (all occurrences) should read -- Polymerization --.

UNITED STATES PATENT AND TRADEMARK OFFICE

CERTIFICATE OF CORRECTION

PATENT NO. : 6,855,469 B2
DATED : February 15, 2005
INVENTOR(S) : Ikeda et al.

It is certified that error appears in the above-identified patent and that said Letters Patent is hereby corrected as shown below:

Column 41,
Table 2 (continued), "Polymerizn" (all occurrences) should read -- Polymerization --.

Signed and Sealed this

Twenty-second Day of November, 2005

JON W. DUDAS
*Director of the United States Patent and Trademark Office*